US005745995A

United States Patent [19]

Yamashita et al.

[11] Patent Number: 5,745,995

[45] Date of Patent: May 5, 1998

[54] ELECTRIC SHAVER WITH SWINGING CUTTER UNIT

[75] Inventors: Yasuo Yamashita; Satoshi Takami, both of Fukuoka, Japan

[73] Assignee: Kyushu Hitachi Maxell, Ltd., Fukuoka-ken, Japan

[21] Appl. No.: 690,729

[22] Filed: Jul. 31, 1996

[30] Foreign Application Priority Data

Jul. 31, 1995 [JP] Japan ..... 7-216813

[51] Int. Cl.[6] ..... B26B 19/16

[52] U.S. Cl. ..... 30/43.6

[58] Field of Search ..... 30/43, 43.4, 43.5, 30/43.6, 43.92, 43.9, 34.1

[56] References Cited

U.S. PATENT DOCUMENTS

| | | | |
|---|---|---|---|
| 4,043,036 | 8/1977 | Stevens, Sr. et al. | 30/43.6 |
| 4,837,929 | 6/1989 | Tanahashi et al. | 30/43.92 |
| 4,910,869 | 3/1990 | Labrijn | 30/43.6 |
| 4,930,217 | 6/1990 | Wolf et al. | 30/43.92 |
| 5,014,428 | 5/1991 | Yamashita | 30/43.6 |
| 5,058,270 | 10/1991 | Deubler et al. | 30/43.92 |
| 5,201,781 | 4/1993 | Jestadt et al. | 30/43.92 |
| 5,245,754 | 9/1993 | Heintke et al. | 30/43.92 |

FOREIGN PATENT DOCUMENTS

| | | | |
|---|---|---|---|
| 0239920 | 7/1987 | European Pat. Off. . | |
| 0386999 | 12/1990 | European Pat. Off. . | |
| 2-131793 | 5/1990 | Japan | 30/43.6 |
| 3-140184 | 6/1991 | Japan . | |
| 6-304346 | 11/1994 | Japan | 30/43.6 |
| 304814 | 8/1955 | Switzerland | 30/43.6 |
| 2038691 | 7/1980 | United Kingdom . | |

*Primary Examiner*—Hwei-Siu Payer

*Attorney, Agent, or Firm*—Birch, Stewart, Kolasch & Birch, LLP

[57] ABSTRACT

An electric shaver is of a type including at least one spirally-bladed cylindrical rotary cutter cooperable with a finely perforated stationary blade foil. The shaver includes a motor casing including a drive motor accommodated therein and having first and second upright walls spaced a distance from each other and accommodated in a shaver casing with the first and second upright walls protruding upwardly outwardly from the top end of the shaver casing; and a cutter assembly including a generally U-shaped support structure having first and second arms spaced a distance from each other. While the support structure is mounted above the motor casing with the first and second arms pivotally coupled respectively with the first and second upright walls so as to define therebetween a common axis about which the cutter assembly swings relative to the motor casing, the spirally-bladed cylindrical cutter is rotatably mounted on the support structure so as to extend between the first and second arms in parallel relation to the common axis, and a foil-like perforated stationary blade member mounted on the support structure so as to cover the cylindrical cutter in substantially sliding contact therewith. A transmission gear train is disposed within the first arm for transmitting a drive of the drive motor to the spirally-bladed cylindrical cutter.

12 Claims, 30 Drawing Sheets

ELECTRIC SHAVER WITH SWINGING CUTTER UNIT

BACKGROUND OF THE INVENTION 1. (Field of the Invention)

The present invention generally relates to an electric shaver and, more particularly, to the electric shaver of a type including at least one spirally-bladed cylindrical rotary cutter cooperable with a finely perforated stationary blade foil to cut hairs during rotation of the cutter.

2. (Description of the Prior Art)

The electric shave of the type referred to above is not a recent development and is disclosed in, for example, the U.S. Pat. No. 5,014,428, issued May 14, 1991, to Yamashita and the Japanese Laid-open Patent Publication No. 3-140184, published Jun. 14, 1991.

The electric shaver disclosed in U.S. Pat. No. 5,014,428 comprises a generally elongated shaver casing having top and bottom ends opposite to each other and also having a compartment defined therein; a drive motor having a pinion mounted on a drive shaft thereof for rotation together therewith and accommodated within the compartment with the pinion gear protruding outwardly from the top end of the shaver casing; a generally U-shaped support structure having first and second arms spaced a distance from each other and a generally elongated base member secured to respective bottoms of the first and second arms and mounted above the top end of the shaver casing in a non-detachable fashion; at least one spirally-bladed cylindrical cutter rotatably and detachably mounted on the support structure with its opposite ends journalled to the first and second arms, and a stationary blade member including at least one finely perforated stationary blade foil and capped onto the support structure so as to cover the cylindrical cutter in substantially sliding contact therewith; and a drive transmission means disposed substantially within a space between the first and second arms and below the cylindrical cutter and including a crown gear meshed with the pinion gear on the drive shaft of the drive motor.

This USP also discloses the use of an resilient support means for resiliently supporting the support structure so as to permit the support structure to move up and down together with the cylindrical cutter and also with the stationary blade member in a direction generally parallel to a longitudinal sense of the shaver casing. By this provision, an assembly including the stationary blade member and the cylindrical cutter rotatably mounted on the support structure is collapsible to keep the pressure of contact between the user's facial skin and the cylindrical cutter through the stationary blade member substantially constant at all times during an actual shaving operation regardless of irregularities in the user's face. This is possible because during the up and down movement of the assembly, the crown gear mounted on a transmission shaft forming a part of the drive transmission means and rotatably journalled by the support structure so as to extend perpendicular to the longitudinal axis of the pinion gear on the drive shaft permits the pinion gear to move up and down relative to the crown gear in a direction perpendicular to the transmission shaft.

On the other hand, the Japanese Laid-open Patent Publication referred to above discloses an electric shaver of a structure substantially similar to that disclosed in the above discussed USP, except that the drive motor, the cylindrical cutter and the drive transmission means are integrated together in a drive unit. Accordingly, the drive unit disclosed in this Japanese publication is movable up and down.

However, the both has an additional problem in that removal of the cylindrical cutter for, for example, cleaning or replacement purpose requires a complicated and time-consuming procedure. Specifically, in any one of the known electric shaver, the cylindrical cutter is adapted to be moved in a direction generally axially of the cylindrical cutter during removal or mounting of the cylindrical cutter from or to an operative position relative to the support structure. A lock mechanism is employed for locking the cylindrical cutter in position once it has been inserted to the operative position. Assuming that the cylindrical cutter is held in the operative position, removal thereof is carried out by releasing the lock mechanism with one hand and pulling the cylindrical cutter axially thereof out of the support structure with the opposite hand. Thus, the user is required to manipulate his or her hands to remove the cylindrical cutter, or the cylindrical cutter will be inadvertently dropped onto, for example, the floor. The necessity of the cylindrical cutter being moved in a direction axially thereof during the removal thereof requires the user to exactly align the removed cylindrical cutter with a designed path for movement thereof and, unless this alignment is performed substantially exactly, the user would get hurt in his fingers.

In addition, none of the prior art electric shavers discussed above employ the capability of the assembly or the drive unit to swing back and forth.

Apart from the above discussed prior art electric shaver of the type including at least one spirally-bladed cylindrical rotary cutter cooperable with a finely perforated stationary blade foil to cut hairs during rotation of the cutter, most commercially available electric shavers of a type including a reciprocating inner blade member cooperable with a finely perforated stationary blade member are provided with a head swing mechanism for permitting a shaving head, including the inner blade member and the stationary blade member, to swing back and forth, an example of which is disclosed in, for example, the U.S. Pat. No. 5,201,781, issued Apr. 13, 1993, to Jestädt et al. and U.S. Pat. No. 5,245,754, issued Sep. 21, 1993, to Heintke et al.

The head swing mechanism disclosed in any one of those U.S. Pat. No. 5,201,781 and U.S. Pat. No. 5,245,754 is unique to the reciprocating-type electric shavers and is inapplicable to the specific type to which the present invention pertains. In those reciprocating-type electric shaver, all that is necessary for the shaving head to be swingable back and forth is essentially a transverse slot through which an eccentric drive shaft rotatable together with the drive motor can move relative to the shaving head during the swinging motion of the latter.

SUMMARY OF THE INVENTION

Therefore, the present invention has been devised with a view to substantially eliminating the above discussed problems inherent in the prior art electric shavers and is intended to provide an improved electric shaver of a type including at least one cylindrical rotary cutter cooperable with a finely perforated stationary blade foil to cut hairs during rotation of the cutter.

In order to accomplish this and other objects and features of the present invention, the electric shaver herein disclosed comprises a generally elongated shaver casing having top and bottom ends opposite to each other and also having a compartment defined therein; a motor casing including a drive motor accommodated therein and having first and second upright walls spaced a distance from each other and accommodated within the compartment with the first and second upright walls protruding upwardly outwardly from the top end of the shaver casing; and a cutter assembly including a generally U-shaped support structure having first and second arms spaced a distance from each other.

While the support structure referred to above is mounted above the motor casing with the first and second arms pivotally coupled respectively with the first and second upright walls so as to define therebetween a common axis about which the cutter assembly swings relative to the motor casing, the cutter assembly also includes at least one cylindrical cutter rotatably mounted on the support structure so as to extend between the first and second arms in parallel relation to the common axis and a driven gear mounted thereon for rotation together therewith, and a foil-like perforated stationary blade member mounted on the support structure so as to cover the cylindrical cutter in substantially sliding contact therewith, and a drive transmission means disposed within the first arm for transmitting a drive of the drive motor to the cylindrical cutter.

The drive transmission means referred to above including a final transmission gear disposed coaxial with the common axis and means for transmitting the drive of the drive motor to the final transmission gear. The driven gear fast with the cylindrical cutter is constantly meshed with the final transmission gear regardless of the swinging motion of the cutter assembly relative to the motor casing.

Preferably, an resilient support means may be employed for resiliently supporting the motor casing within the compartment to permit the motor casing to move up and down together with the cutter assembly in a direction generally parallel to a longitudinal sense of the shaver casing.

In a preferred embodiment of the present invention, the support structure includes a generally rectangular support base having first and second brackets lying generally perpendicular to the support base mounted above the motor casing with the first and second brackets pivotally coupled with the first and second upright walls so as to define the common axis, and a cutter holder including a generally rectangular base plate having first and second end walls lying generally perpendicular to the base plate. Where this support structure is employed, the cylindrical cutter is to be rotatably supported above the base plate and between the first and second end walls with the driven gear positioned on one side of the first bracket opposite to the cylindrical cutter and, on the other hand, the stationary blade member is detachably mounted on the cutter holder. The cutter holder is detachably mounted on the support base with the base plate held in contact with the support base and with the first and second end walls adjoining respectively the first and second brackets to define the associated first and second arms of the support structure.

The electric shaver may further comprises first and second cover members fitted exteriorly to the first and second end walls, respectively, of the cutter holder. These first cover members are used to conceal a portion of the driven gear and, in such case, the final transmission gear is interposed between the first bracket of the support base and the first upright wall of the motor casing such that, when the cutter holder is mounted on the support base, the remaining portion of the driven gear that is exposed outside of the first cover member is drivingly engaged with the final transmission gear.

Also, the electric shaver may further comprises a safety switch means for interrupting a supply of an electric power to the drive motor in response to removal of the stationary blade member from the support base. This safety switch means may comprises an electric switch element disposed within the second upright wall of the motor casing, an actuator piece interposed between the second upright wall of the motor casing and the second bracket of the support base and having an actuator pin formed therewith so as to extend axially movably through the second bracket of the support base, said actuator piece being also formed with an actuator projection protruding outwardly therefrom in a direction counter to the actuator pin and operatively coupled with the switch element, and a biasing element interposed between the second upright wall of the motor casing and the actuator piece for urging the actuator towards the second bracket of the support base to allow the actuator piece to be rotated together with the swinging motion of the cutter assembly. The actuator pin has a free end engageable with the stationary blade member such that when the stationary blade member is mounted on the support base with the cylindrical cutter positioned inside the stationary blade member, the actuator pin is axially moved against the biasing element to cause the actuator projection t operate the switch element.

In any event, the number of the cylindrical cutter may not be always limited to one, but two or three similar or identical cylindrical cutters may equally be employed. Where the two cylindrical cutters are employed, the second cylindrical cutter is to be rotatably mounted on the support structure so as to extend between the first and second arms in parallel relation to the common axis and also to the first cylindrical cutter. An additional driven gear is needed on one end of the second cylindrical cutter adjacent the first arm in coaxial relation to the second cylindrical cutter and should be meshed with the final transmission gear.

BRIEF DESCRIPTION OF THE DRAWINGS

This and other objects and features of the present invention will become clear from the following description taken in conjunction with preferred embodiments thereof with reference to the accompanying drawings, in which like parts are designated by like reference numerals and in which.

DETAILED DESCRIPTION OF THE EMBODIMENT

Figure 1:
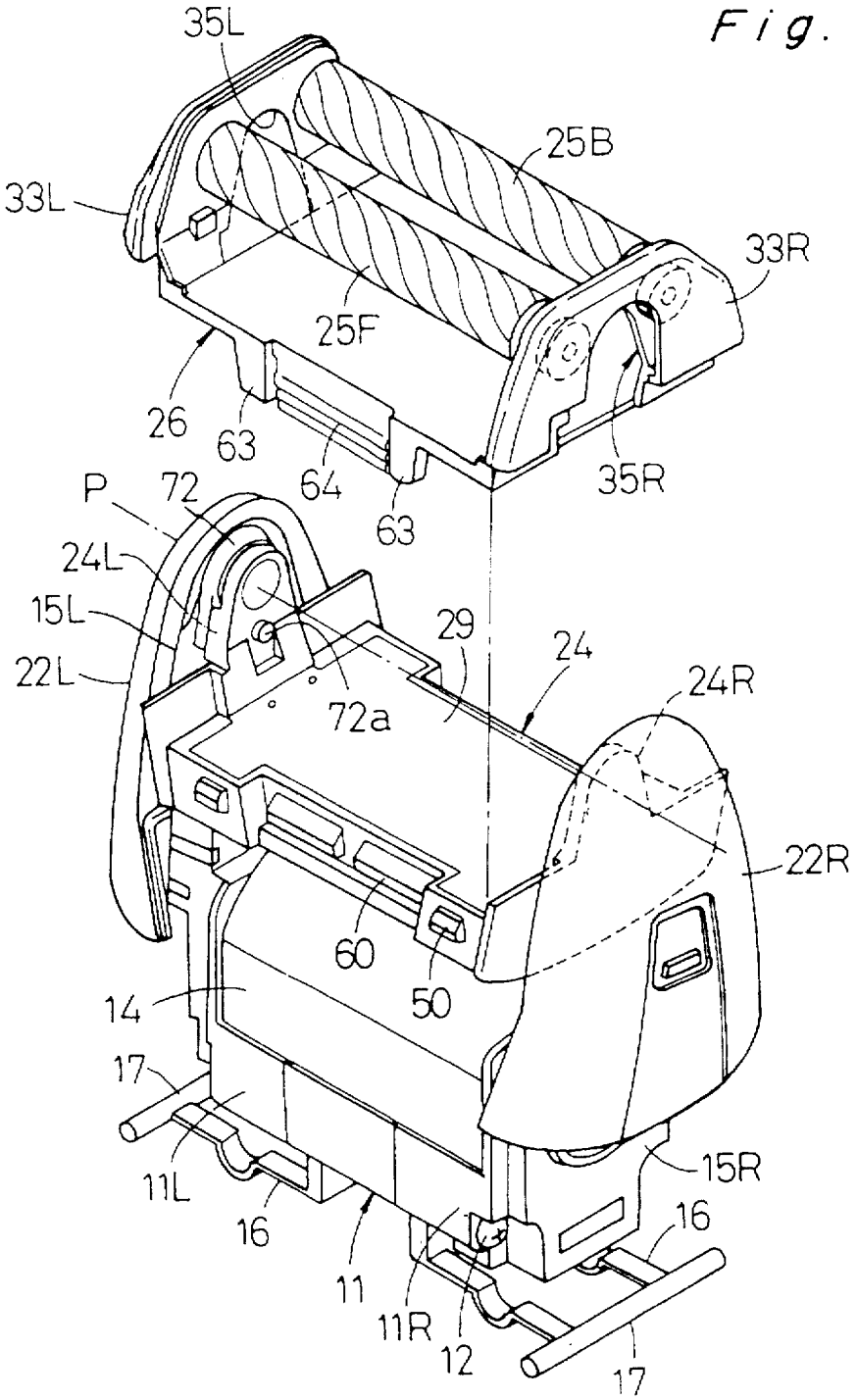
FIG. 1 is an exploded view of a shaving head, with a stationary blade assembly removed, of an electric shaver according to the present invention.
Figure 2:
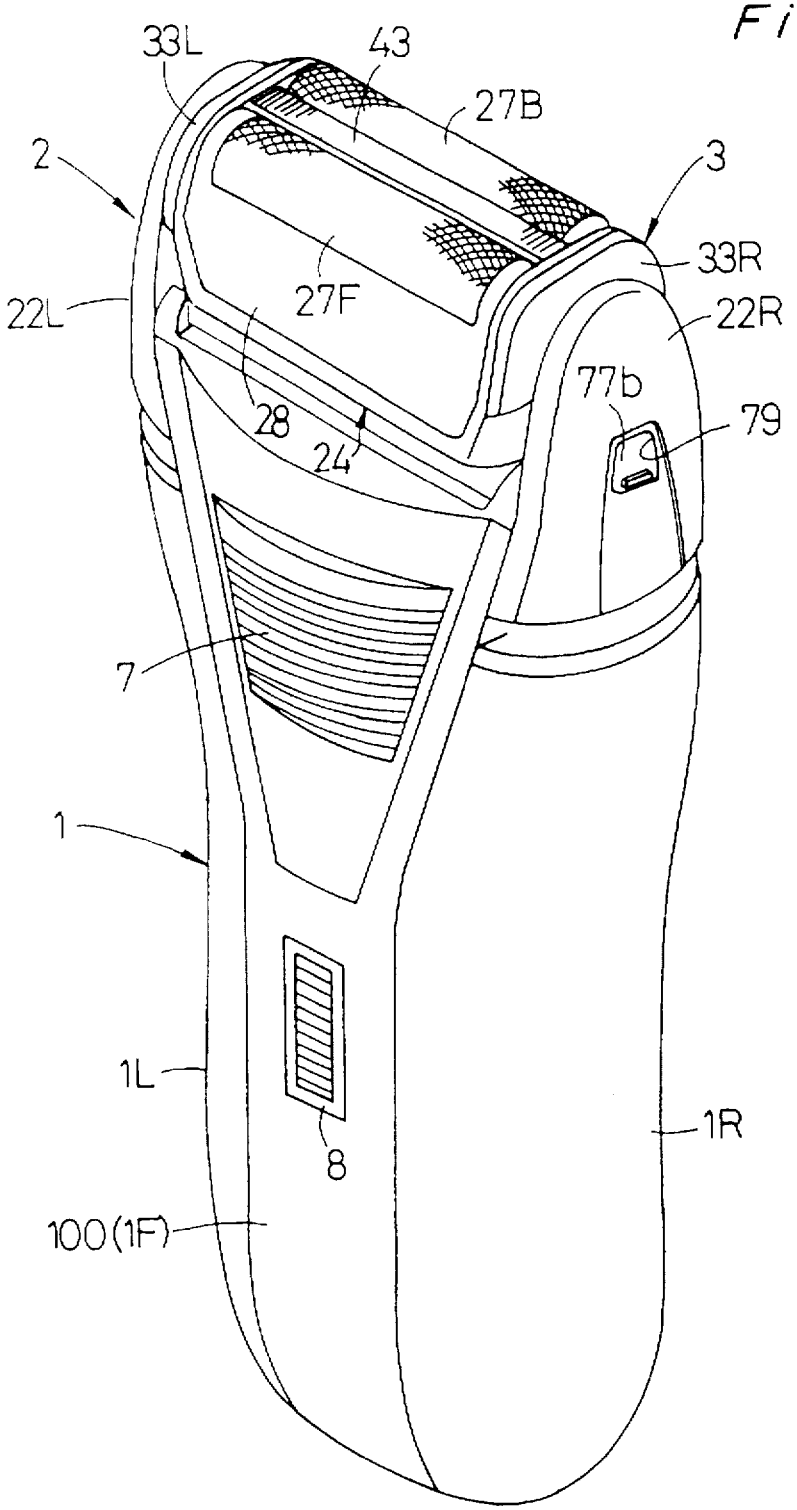
FIG. 2 is a perspective view of the electric shaver according to the present invention.
Figure 3:
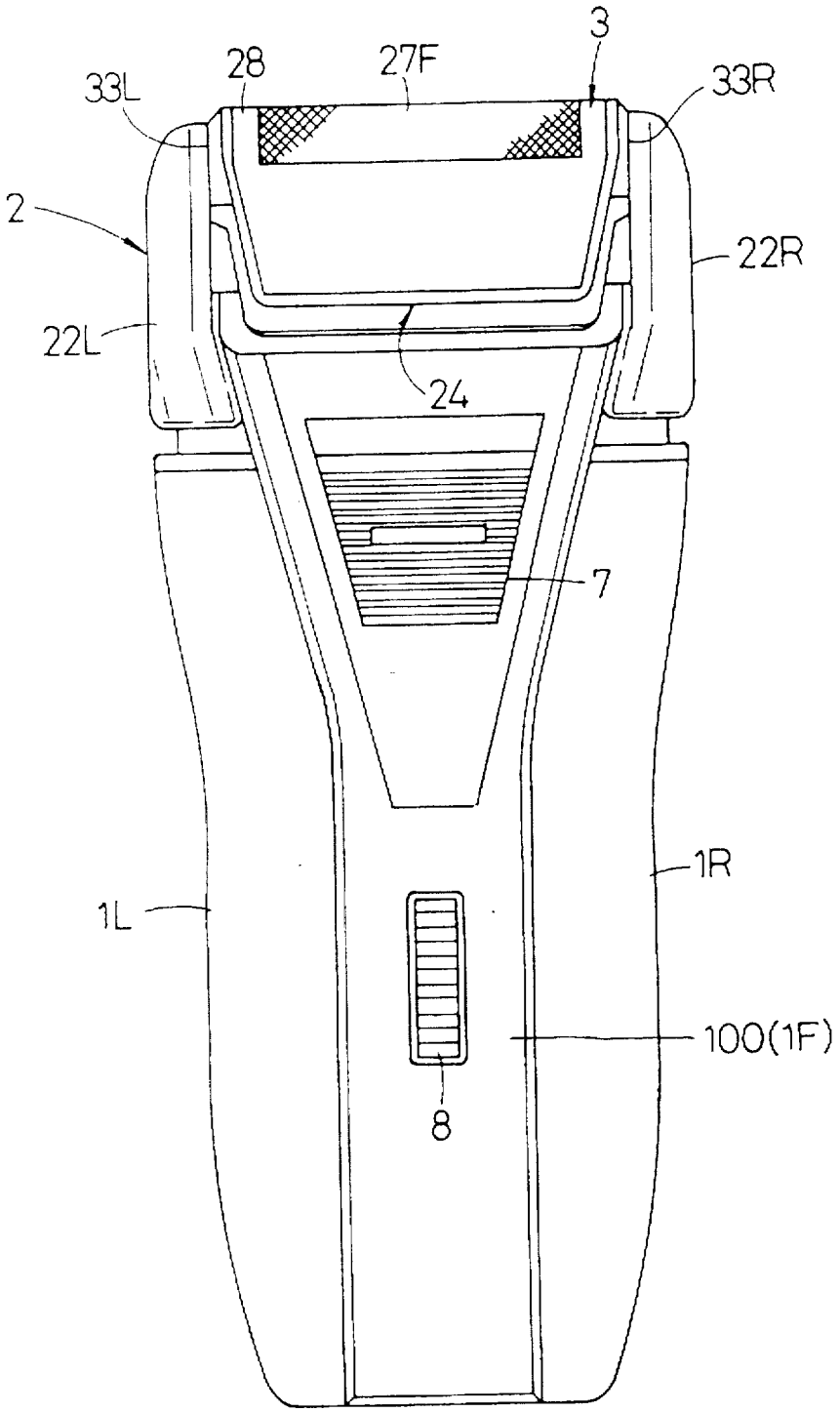
FIG. 3 is a front elevational view of the electric shaver shown in FIG. 2.
Figure 4:
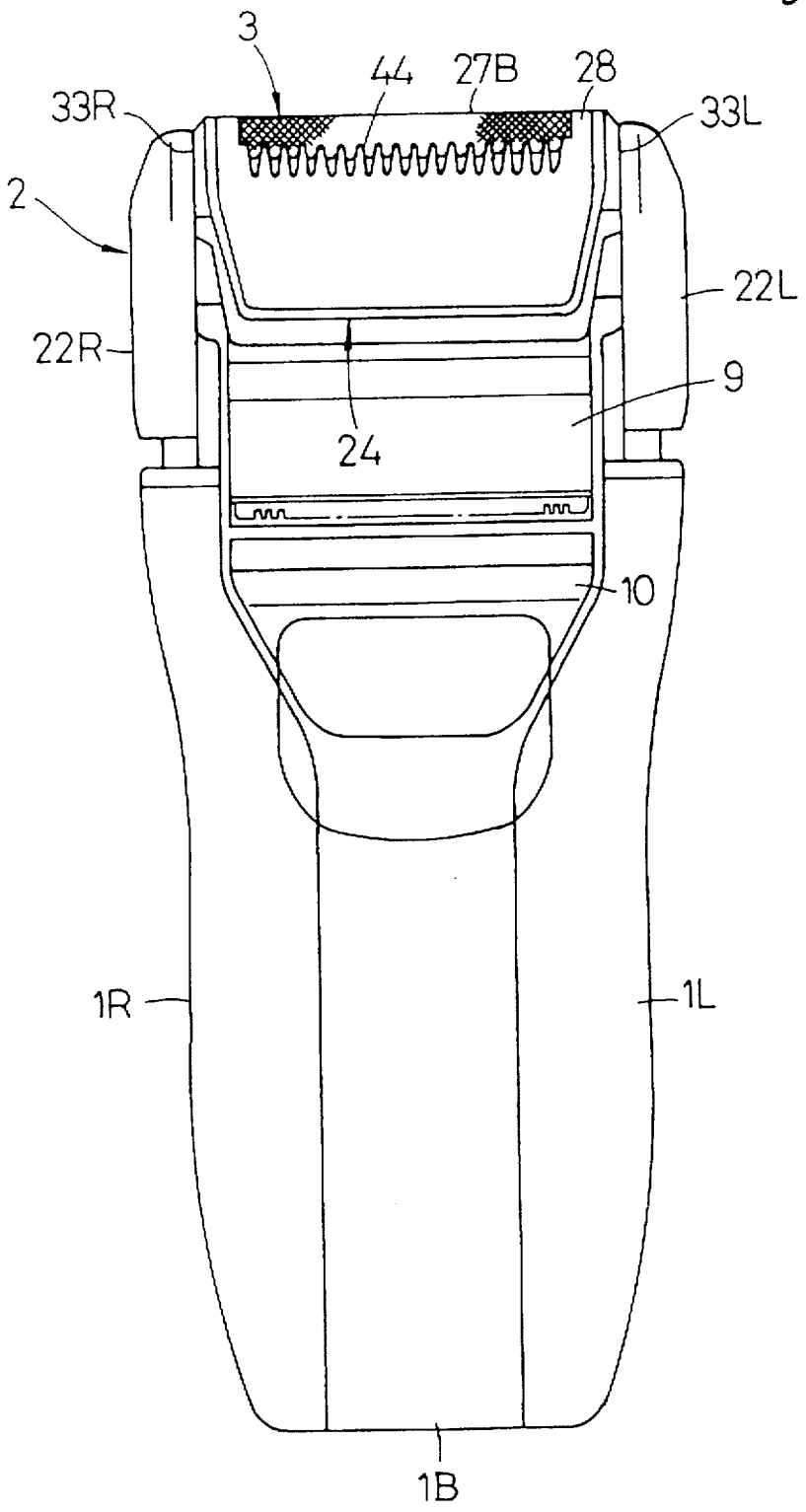
FIG. 4 is a rear elevational view of the electric shaver shown in FIG. 3.
Figure 5:
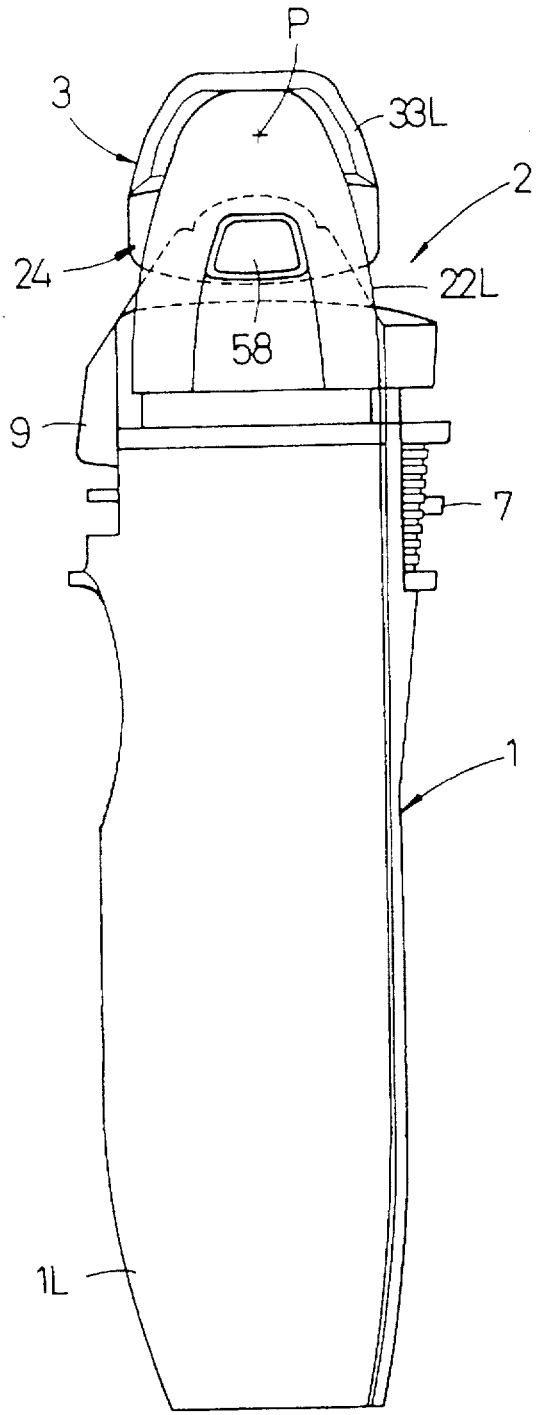
FIG. 5 is a side elevational view of the electric shaver shown in FIG. 3.
Figure 6:
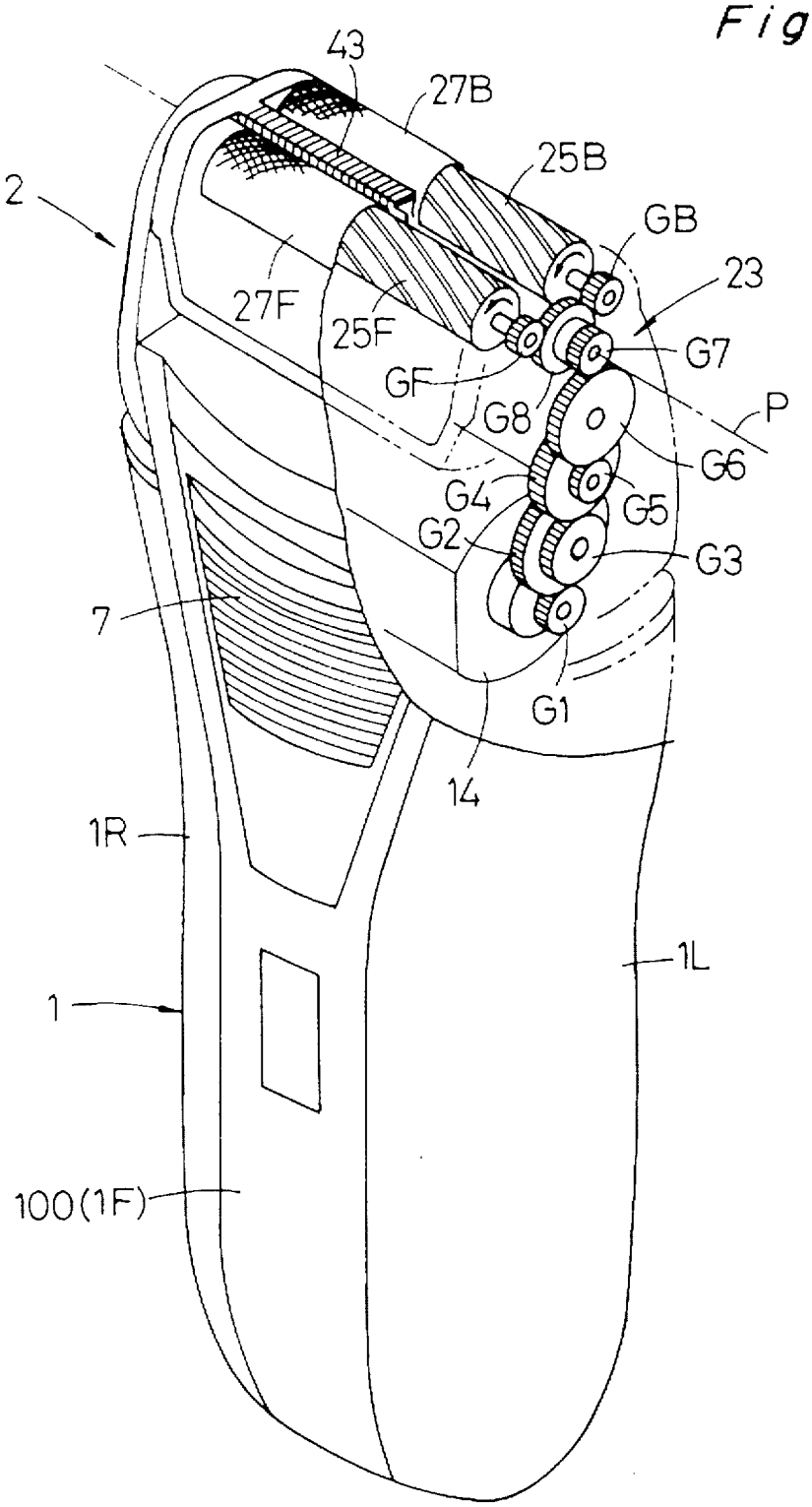
FIG. 6 is a view similar to FIG. 2, with a portion of the shaving head cut away to show a transmission gear train employed in the electric shaver.

Referring to FIGS. 1 to 6 and 29, there is shown an electric shaver of a twin-cutter type including two spirally-bladed cylindrical cutters 25F and 25B extending parallel to each other, each having left and right stud shafts coaxially protruding outwardly from the opposite ends to the spirally-bladed cylindrical cutter 25F or 25B. The illustrated electric shaver comprises a generally elongated casing 1 having top and bottom ends opposite to each other, and a shaving head 2 mounted atop the casing 1 in a floating fashion, that is, for movement over a slight distance axially relative to the casing 1 as will be described later. The spirally-bladed cylindrical cutters 25F and 25B are of a known structure and are supported in the shaving head 2 in a manner as will be described later for rotation in the same direction.

As best shown in FIGS. 6, 7, 9 and 29, the casing 1 is of a split design including front and rear casing halves 1F and 1B of a generally U-shaped cross-section connected together by means of a plurality of set screws so as to define a compartment therebetween, and side coverings 1L and 1R that are snapped onto left and right side portions of the coupled casing halves 1F and 1B. The side coverings 1L and 1R are not always essential in the practice of the present invention and may be dispensed with if desired, however, the side coverings 1L and 1R when used are effective to make up the electric shaver to have an appealing feature and also to have an ergonomically styled grip region. The compartment so defined between the front and rear casing halves 1F and 1B combined together is divided into a circuit chamber, accommodating therein at least one printed circuit board 4 (two printed circuit boards 4 being shown in FIG. 29), two rechargeable batteries 5 and related electric component parts, and a head chamber accommodating a part of the shaving head 2. The casing 1 has a terminal connector 6 clamped in position so as to open outwardly from the bottom of the casing 1 for releasably receiving a power supply line (not shown) that may be connected thereto when the batteries 5 are to be recharged.

The casing 1 has a switch knob 7 mounted on a front face thereof for sliding motion between ON and OFF positions in a direction parallel to the longitudinal sense of the casing 1, and a battery indicator 8 also mounted on the front face thereof at a location immediately below the switch knob 7. The casing 1 also has a decorative front panel 100 fitted to the front face thereof in any suitable manner with the switch knob 7 and the battery indicator 8 exposed to the outside so that a user of the electric shaver can manipulate the switch knob 7 and look at the battery indicator 8 from outside. The battery indicator 8 may be of any known structure and may be of a type which may blink when the batteries are ready to run out, but in the illustrated embodiment the battery indicator 8 is comprised of a row of light emitting diodes and is so designed that the number of the light emitting diodes that are turned on when the switch knob 7 is moved to the ON position decreases with decrease of the electric power remaining in the batteries 5.

The casing 1 furthermore has a trimmer unit 9 mounted on a rear face thereof for pivotal movement between folded and flipped positions and an operating knob 10 also mounted on the rear face thereof at a location immediately below the trimmer unit 9. As is well-known to those skilled in the art, the trimmer unit 9 may, when moved to the flipped position by manipulation of the operating knob 10, be used to trim, for example, sideburns.

Figure 13:
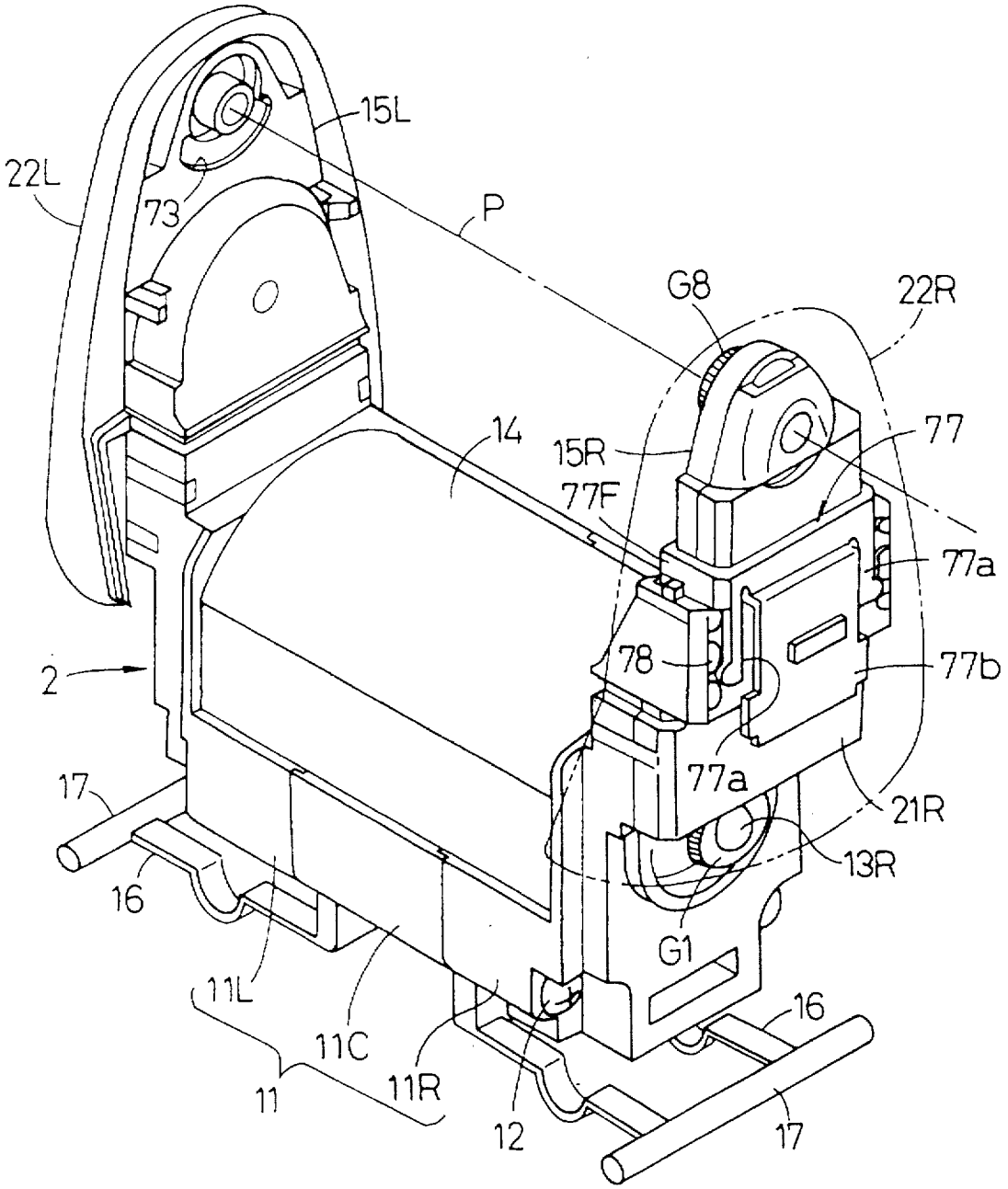
FIG. 13 is a perspective view, on an enlarged scale, of the shaving head employed in the electric shaver.
Figure 14:
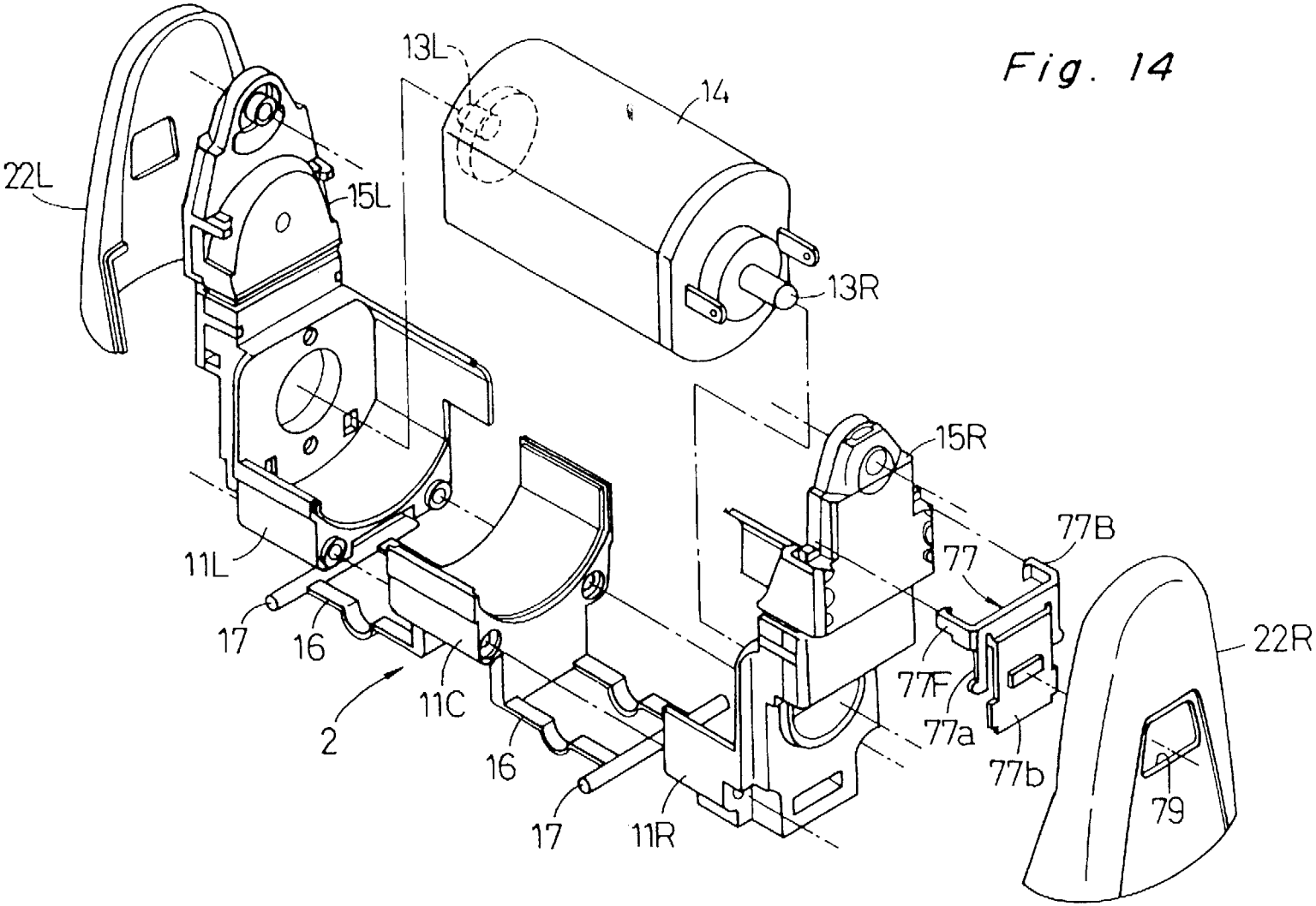
FIG. 14 is an exploded view of the shaving head shown in FIG. 13.
Figure 15:
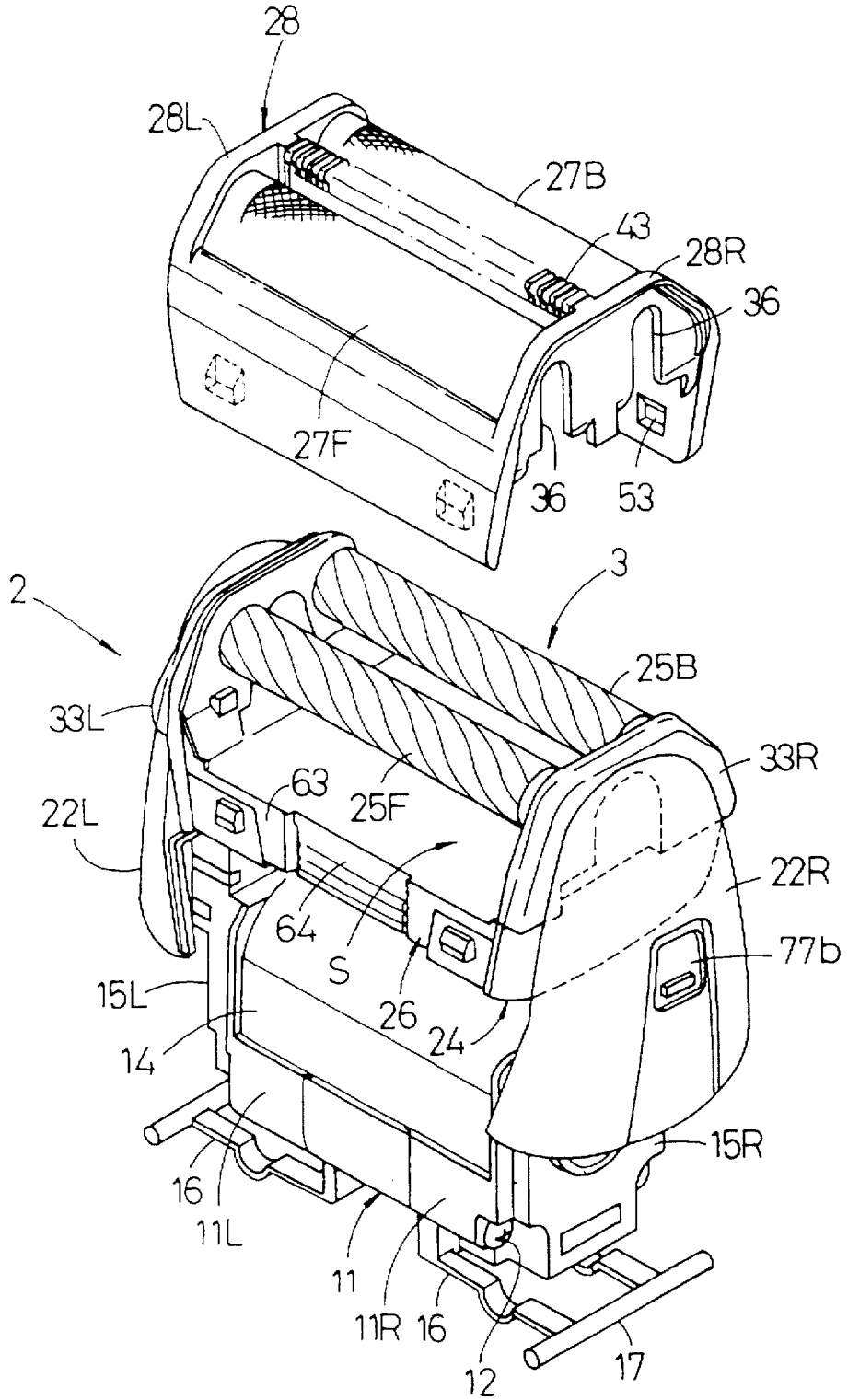
FIG. 15 is a perspective view of the shaving head with the stationary blade assembly shown as separated from a cutter unit.
Figure 16:
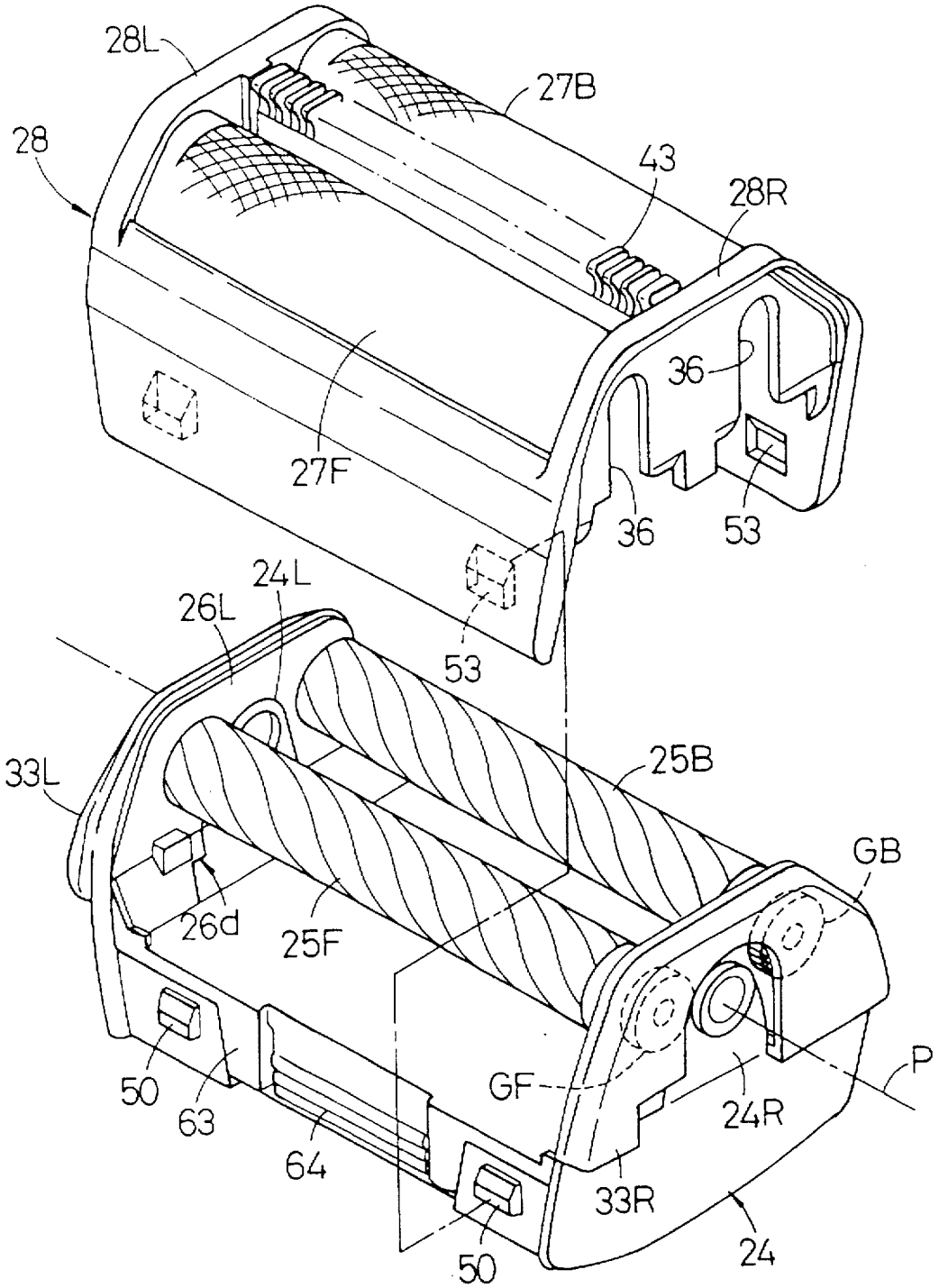
FIG. 16 is a perspective view of a stationary blade holder with the stationary assembly and the cutter unit shown as separated from each other.

As best shown in FIGS. 13 and 14, the shaving head 2 includes a head casing 11 of a generally rectangular box-like configuration. This head casing 11 includes left and right casing segments 11L and 11R of a substantially identical configuration and a center casing segment 11C positioned between the left and right casing segments 11L and 11R. The left and right casing segments 11L and 11R are coupled in an end-to-end fashion by means of connecting screws 12 with the center casing segment 11C positioned therebetween. A drive motor 14 of a type having coaxial output shafts 13L and 13R protruding outwardly from opposite ends of the body of the motor 14 in respective directions away from each other is steadily received horizontally in a substantially embraced fashion within the head casing 11. In this condition, the output shafts 13L and 13R of the drive motor 14 rotatably protrude outwardly from the head casing 11 in a direction substantially perpendicular to the longitudinal sense of the head casing 11.

The head casing 11 has left and right ends opposite to each other and also has left and right upright walls 15L and 15R mounted fixedly on, or otherwise formed integrally with, the left and right ends thereof so as to extend upwardly in a direction substantially perpendicular to the longitudinal sense of the head casing or parallel to the longitudinal sense of the casing 1. The shaving head 2 of the structure discussed above is mounted on the casing 1 with the head casing 11 encased in the head chamber of the compartment and with the upright walls 15L and 15R protruding upwardly outwardly through associated openings defined at the upper end of the casing 1. It is to be noted that in this assembled condition the head casing 11 accommodated within the head chamber of the compartment of the housing 1 is so loosely encased as to be movable up and down in a direction generally parallel to the longitudinal sense of the casing 1 as will be described later. A cutter unit 3 including the spirally-bladed cylindrical cutters 25F and 25B is supported between the upright walls 15L and 15R in a manner which will subsequently be described.

Figure 7:
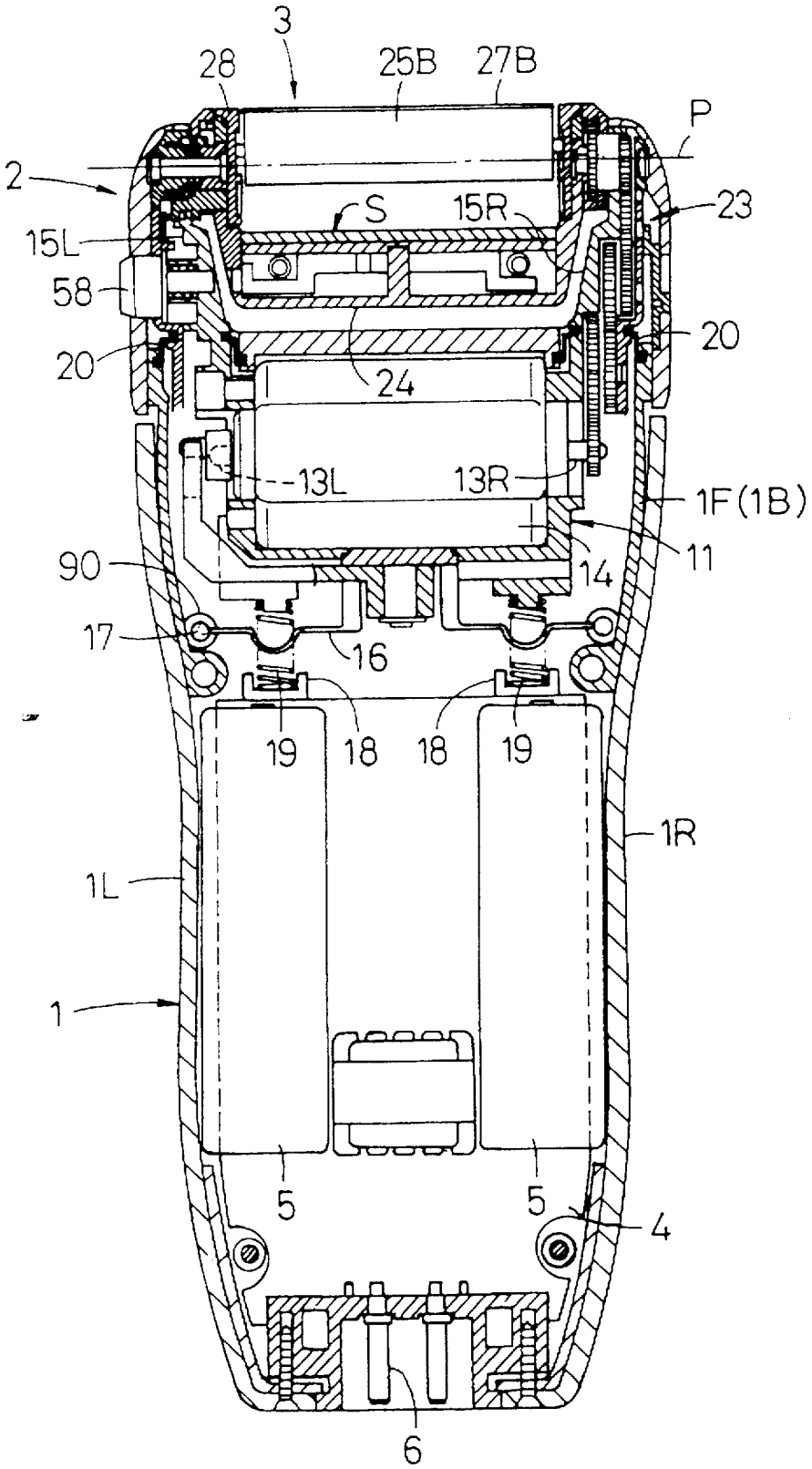
FIG. 7 is a longitudinal sectional view of the electric shaver according to the present invention.

As shown in FIGS. 1 and 7, the center casing segment 11C has a bottom wall formed integrally with generally L-shaped left and right, thin-walled arms 16 each extending downwardly from the bottom of the center casing segment 11*c* and then bent at right angles so as to extend towards the adjacent side wall of the casing 1 with its free end integrally formed with a respective anchor pin 17 lying in a direction perpendicular to the longitudinal sense of the head casing 11. The head casing 11 having the drive motor 14 therein is accommodated within the head chamber in the casing 1 with opposite ends of the anchor pins 17 received in corresponding bosses 90 that are integrally formed with the front and rear casing halves 1F and 1B, two bosses 90 in each casing half 1F and 1B. Since each of the L-shaped left and right arms 16 is preferably made of plastics and is thin-walled enough to permit it to be elastically deformable, the head casing 11 so supported in the head chamber is movable up and down between projected and collapsed positions as discussed above against the resiliency of those thin-walled arms 16. The head casing 11 is, however, normally biased to the projected position by a composite force of the thin-walled arms 16 and compression springs 19, each of said compression springs 18 being interposed between the bottom of the left or right casing segment 11L or 11R and a corresponding spring seat 18 integrally formed with one of the front and rear casing halves, for example, the front casing half 1F. Generally ring-shaped seal members 20 are mounted on the respective upright walls 15L and 15R of the head casing 11 while seated on the left and right casing segments 11L and 11R of the head casing 11, and sandwiched between them and associated peripheral lip regions of the top end of the casing 1 around the openings for passage therethrough of the upright walls 15L and 15R to seal off possible gaps to thereby avoid any possible ingress of foreign matter such as dusts and/or hair clippings or flocks into the compartment in the housing 1.

Figure 8:
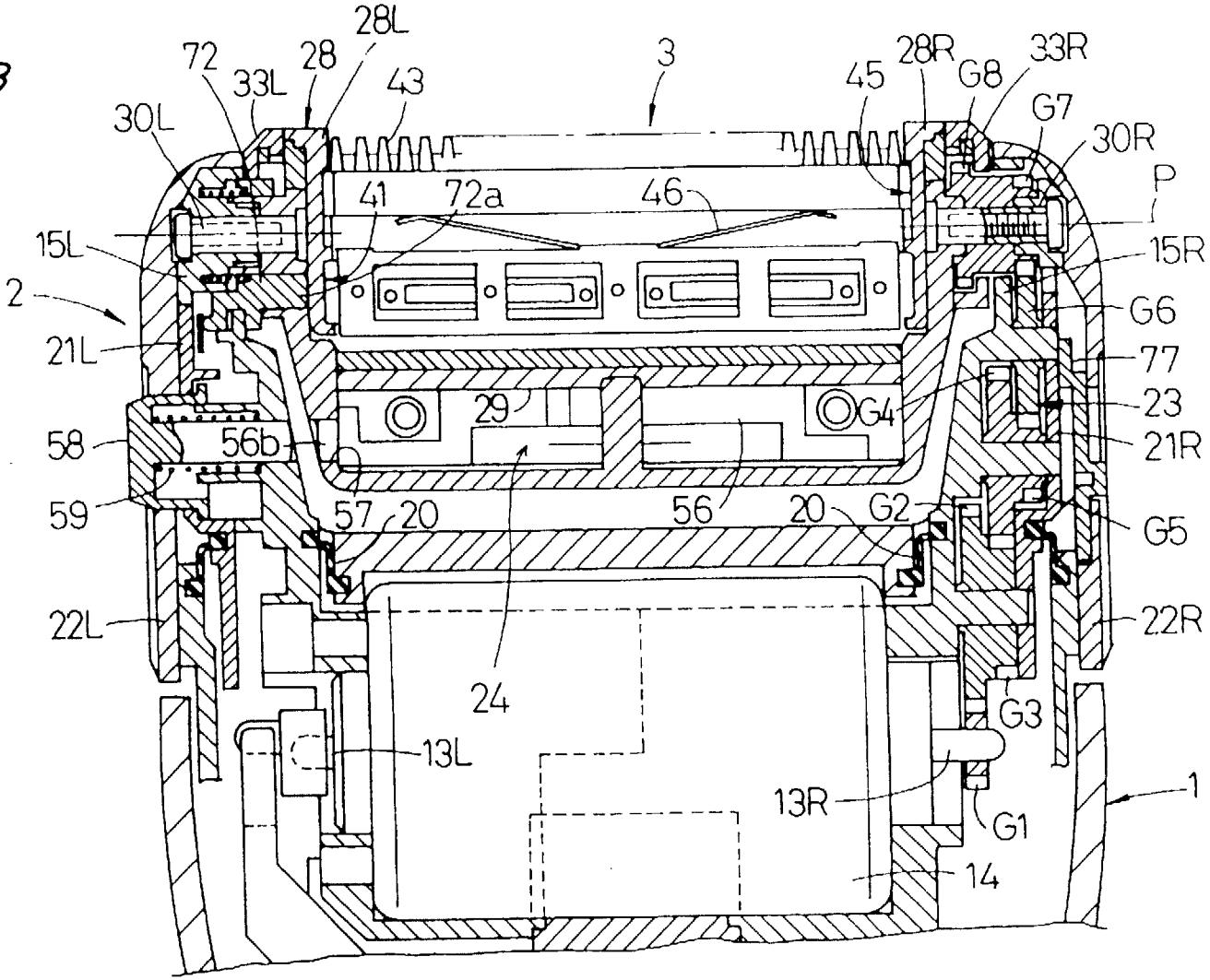
FIG. 8 is a longitudinal sectional view, on a somewhat enlarged scale, of the shaving head.
Figure 9:
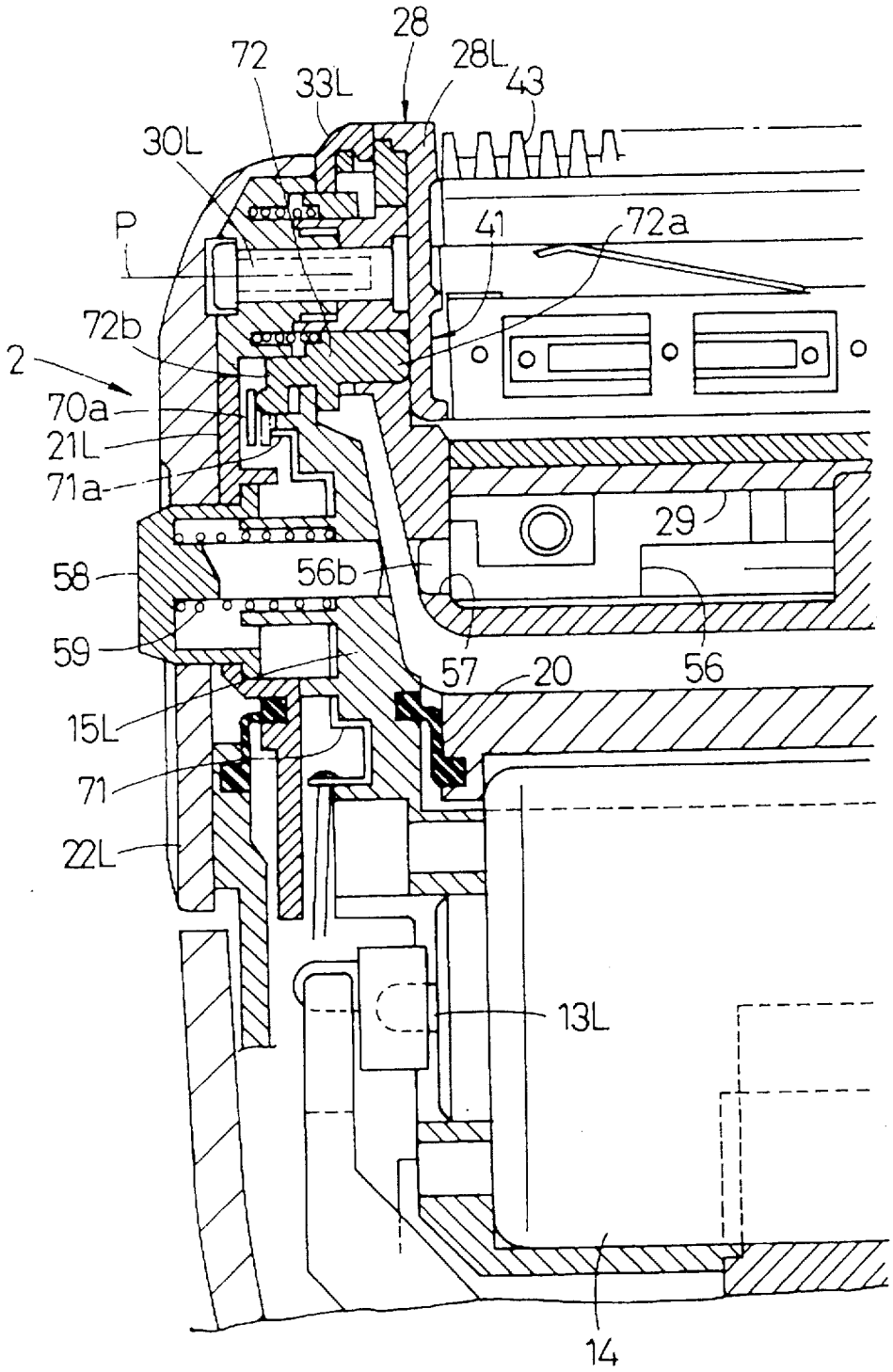
FIGS. 9 and 10 are fragmentary longitudinal sectional views, on a further enlarged scale, showing left and right halves of the shaving head employed in the electric shaver according to the present invention, respectively.
Figure 10:
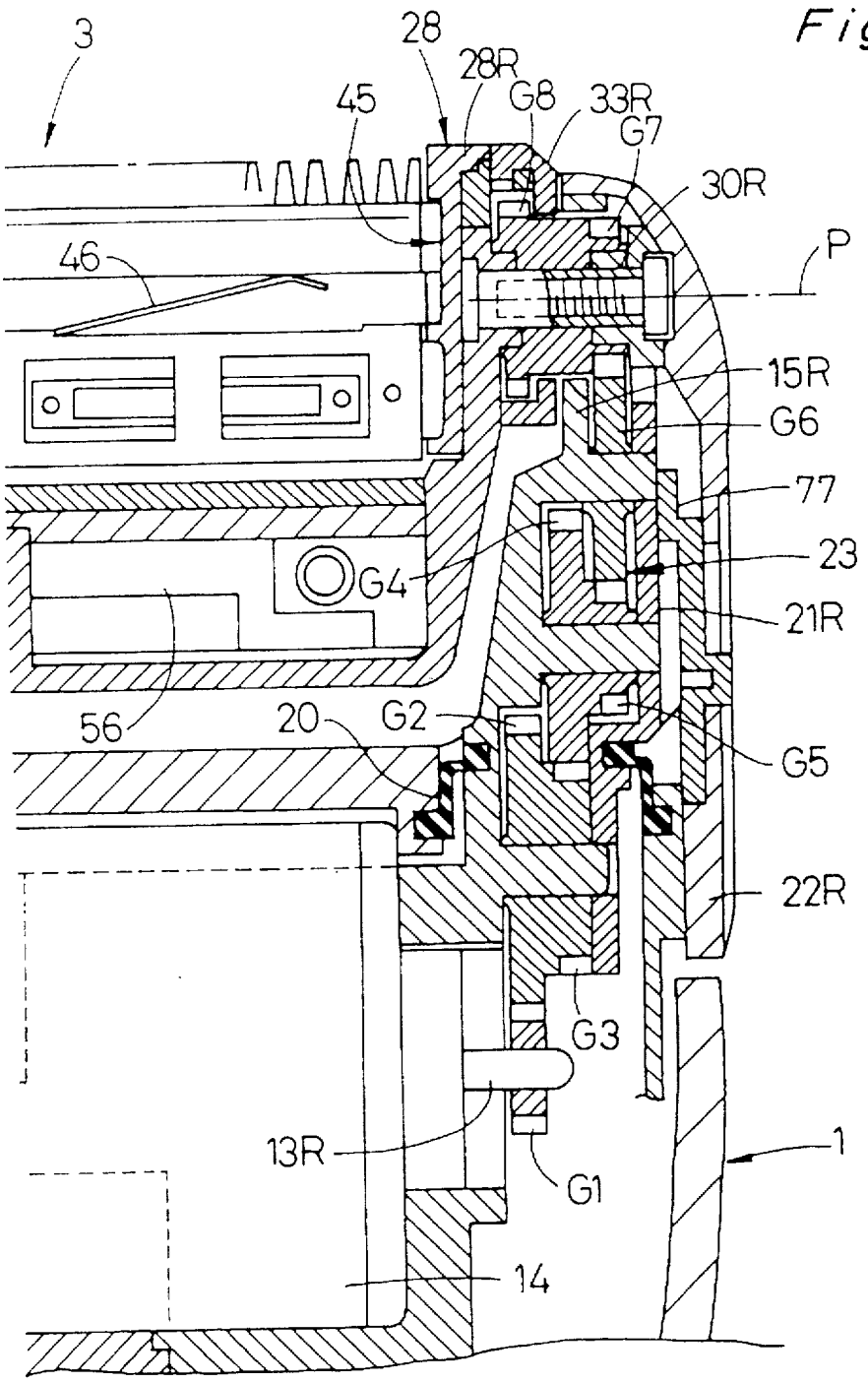
Figure 11:
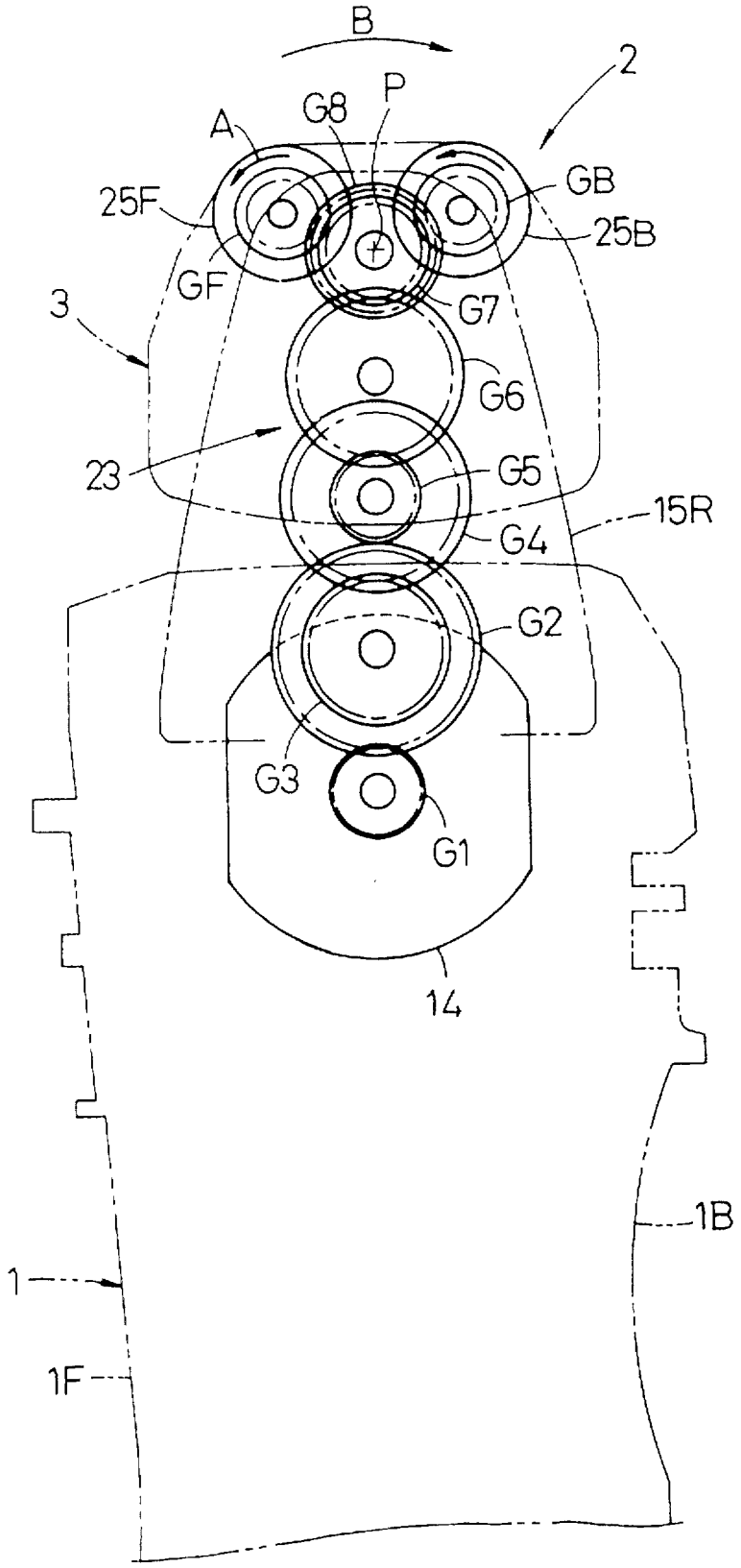
FIG. 11 is a schematic fragmentary side view of the electric shaver, showing the details of the transmission gear train for transmitting a drive to spirally-bladed cylindrical cutters.
Figure 12:
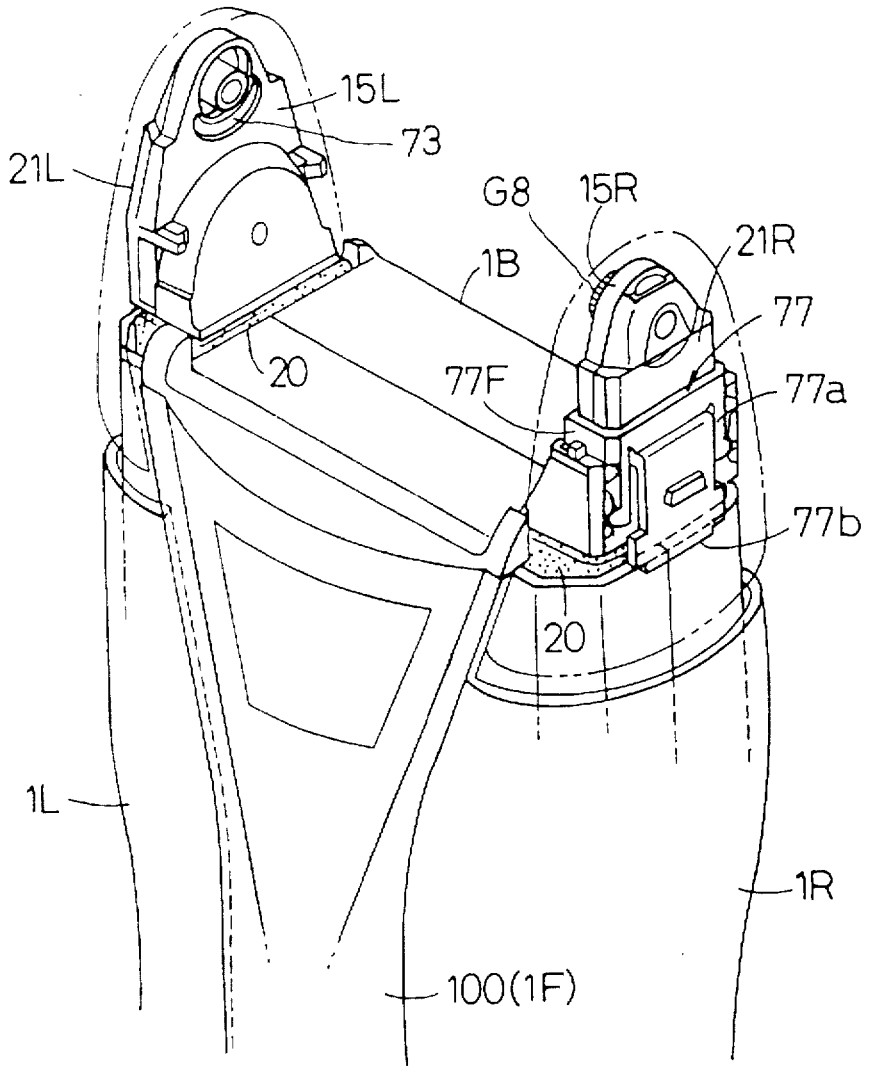
FIG. 12 is a perspective view of a top portion of the electric shaver, showing the shaving head with the cylindrical cutters removed.

Referring now to FIGS. 8 to 14, the left and right upright walls 15L and 15R have generally plate-like caps 22L and 22R snap-fitted exteriorly to the associated left and right upright walls 15L and 15R, which caps are in turn covered by left and right cover plates 21L and 21R also snap-fitted to the respective upright walls 15L and 15R. Each of the left and right upright walls 15L and 15R has a recess extending inwardly from an outer surface of the corresponding upright wall 15L and 15R, which when covered by the corresponding plate-like cap 22L and 22R defines a chamber between the upright wall 15L and 15R and the plate-like cap 22L and 22R. Specifically, the chamber defined between the right upright wall 15R and the associated plate-like cap 22R is used to accommodate a drive transmitting gear train 23 for transmitting the drive of the drive motor 14 to the cutter unit 3 as best shown in FIG. 10.

The drive transmitting gear train 23 referred to above includes a first or drive gear G1 mounted on the output shaft 13R of the drive motor 14 for rotation together therewith, a second intermediate gear G2 meshed with the drive gear G1, a third intermediate gear G3 coaxially integrally formed with and undersized relative to the second intermediate gear G2, a fourth intermediate gear G4 meshed with the third intermediate gear G3, a fifth intermediate gear G5 coaxially integrally formed with and undersized relative to the fourth intermediate gear G4, a sixth intermediate gear G6 meshed with the fifth intermediate gear G5, a seventh intermediate gear G7 meshed with the sixth intermediate gear, and a final transmission gear G8 coaxially integrally formed with the seventh intermediate gear G7. It is to be noted that for the reason which will become clear from the subsequent description, the final transmission gear G8 is positioned on one side of the associated upright wall 15R confronting the opposite upright wall 15L.

The chamber defined between the left upright wall 15L and the associated plate-like cap 22L as best shown in FIG. 9 is used to accommodate another drive transmission mechanism for drivingly coupling the output shaft 13L of the drive motor 14 to the trimmer unit 9 as will be described later.

Figure 17:
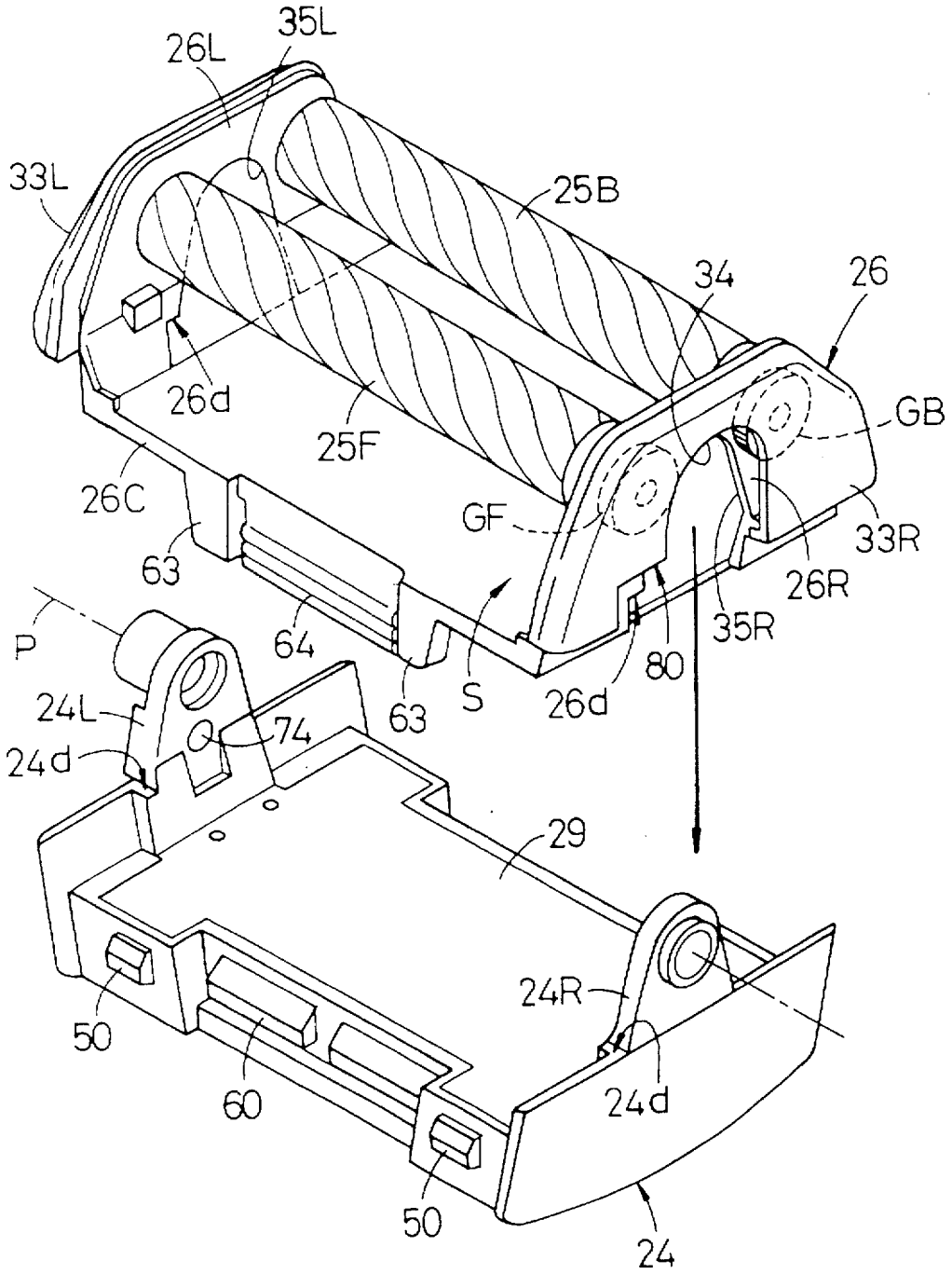
FIG. 17 is a perspective view of a cutter holder, carrying the cylindrical cutters, and a support base for the support of the cutter holder, both shown as separated from each other.

As best shown in FIG. 17, the cutter unit 3 includes a generally rectangular support base 24 having left and right upright brackets 24L and 24R integrally formed therewith so as to extend upwardly from respective opposite ends thereof. This support base 24 is supported by the head casing 11 with the upright brackets 24L and 24R journalled to the associated upright walls 15L and 15R such that the support base 24 can swing about a common axis P parallel to the support base 24. The cutter unit 3 also includes a cutter holder 26 having the spirally-bladed cylindrical cutters 25F and 25B rotatably mounted thereon, and a stationary blade holder 28 (FIG. 18) including front and rear perforated stationary blade foils 27F and 27B (FIG. 19) of a substantially identical configuration each so shaped as to have a generally arcuate cross-section in an assembled condition. As will be described later, the stationary blade holder 28 is capped onto the support base 24 after the cutter holder 26 carrying the spirally-bladed cylindrical cutters 25F and 25B have been mounted on the support base 24 and, in this substantially assembled condition of the cutter unit 3, the spirally-bladed cylindrical cutters 25F and 25B have their upper regions received inside respective grooves each delimited by the associated arcuately sectioned stationary blade foil 27F or 27B.

Figure 20:
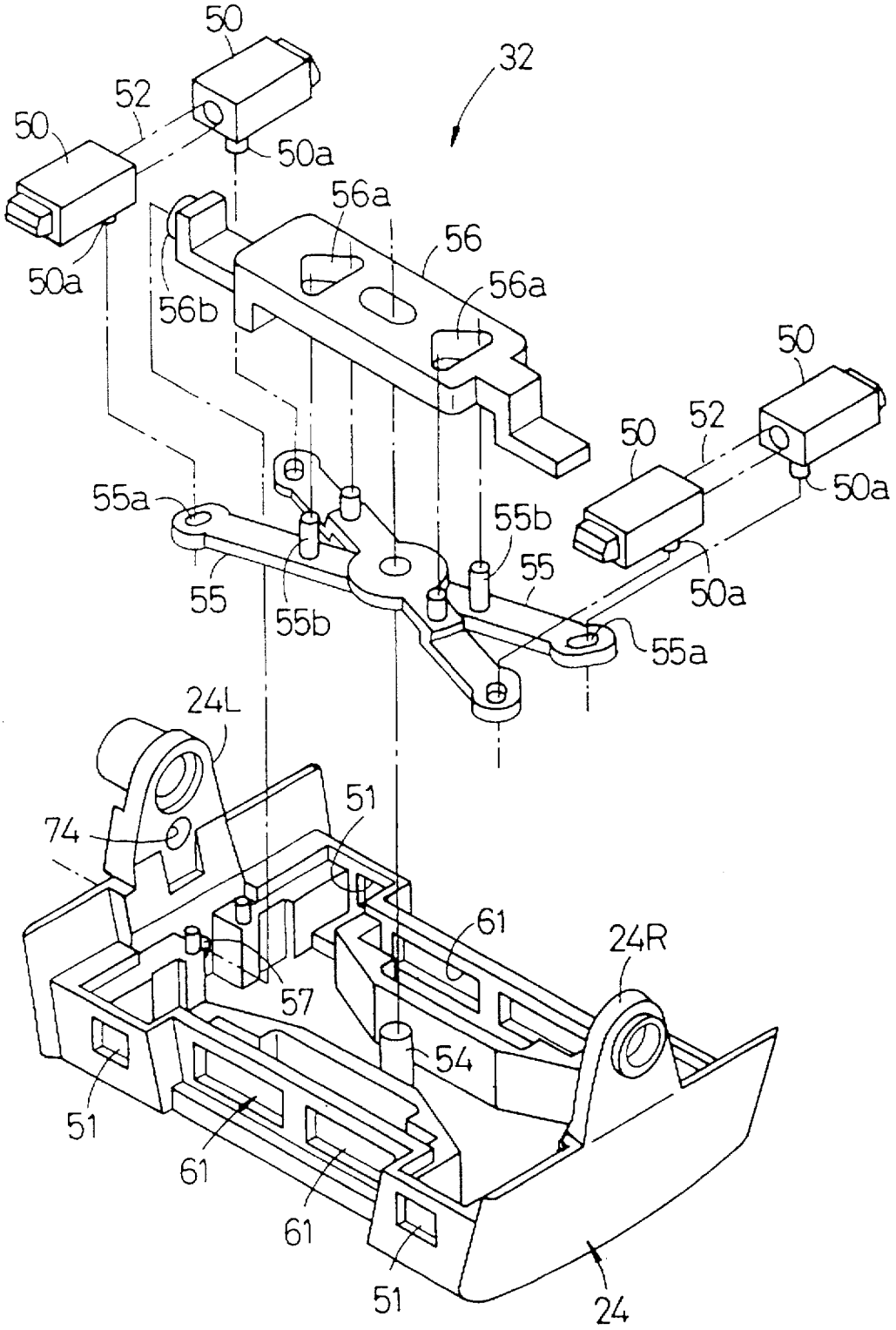
FIG. 20 is an exploded view of the support base, showing lock mechanisms built therein in the electric shaver according to the present invention.

The details of the support base 24 are shown in FIGS. 8 and 20. As shown therein, the support base 24 is of a generally rectangular box-like configuration having a rectangular cavity closed by a rectangular lid 29 snap-fitted thereto. The left and right upright brackets 24L and 24R referred to above, each being of a generally triangular shape, are integrally-formed with opposite end walls so as to extend upwardly therefrom and include left and right pivot shafts 30L and 30R secured to respective apex portions of the upright brackets 24L and 24R so as to extend coaxially in a direction away from each other. The pivot shafts 30L and 30R are in turn rotatably received by the associated upright walls 15L and 15R so that the support base 24 can swing about the common axis P defined by the pivot shafts 30L and 30R. Within the cavity in the support base 24, a releasable lock mechanism 31 (FIG. 22) for the cutter holder 26 and a releasable lock mechanism 32 (FIG. 23) for the stationary blade holder 28 are incorporated.

As shown in FIG. 17, the cutter holder 26 is of a generally U-shaped configuration and is of one-piece construction including a generally rectangular base plate 26c having a flock receiving surface S and left and right end walls 26L and 26R at right angles to the base plate 26c. A space Q (FIG. 22) of a size sufficient to allow a cleaning brush to be inserted underneath the spirally-bladed cylindrical cutters 25F and 25B to sweep the hair clippings or flocks away the flock receiving surface S is defined between the spirally-bladed cylindrical cutters 25F and 25B and the flock receiving surface S of the base plate 26c. The spirally-bladed cylindrical cutters 25F and 25B have their right stud shafts integrally formed with respective input gears GF and GB and are rotatably supported by the cutter holder 26 so as to extend between the end walls 26L and 26R in parallel relation to each other and also to the base plate 26c with the input gears GF and GB positioned on one side of the right end wall 26R of the cutter holder 26 remote from the left end wall 26L.

The left and right end walls 26L and 26R of the cutter holder 26 has respective flat caps 33L and 33R snap-fitted exteriorly thereto. The flat caps 33L and 33R have respective recesses 34 defined therein so as to extend inwardly from a bottom edge thereof adjacent the base plate 26c. In particular, the recess 34 defined in the right flat cap 33R snap-fitted to the right end walls 26 is of a size sufficient to allow respective portions of the input gears GF and GB integral with the spirally-bladed cylindrical cutters 25F and 25B to be exposed to the outside through such recess 34 in the right flat cap 33R. To make the respective portions of the input gears GF and GB exposed to the outside through the recess 34 in the right flat cap 33R is effective to allow the input gears GF and GB to be readily meshed with the final transmission gear G8 of the drive transmitting gear train 23, described previously, when the cutter holder 26 once removed from the support base 24 for, for example, cleaning purpose is to be mounted on the support base 24 of the cutter unit 3.

As shown in FIG. 17, the left and right end walls 26L and 26R of the cutter holder 26 are formed with generally triangular guide recesses 35L and 35R which, when the cutter holder 26 is mounted or capped onto the support base 24, receive therein the respective upright brackets 24L and 24R integral with the support base 24. With the upright brackets 24L and 24R so received within the respective guide recesses 35L and 35R, the cutter holder 26 can be properly positioned relative to the support base 24 with the respective longitudinal axes of the spirally-bladed cylindrical cutters 25F and 25B spaced a predetermined distance from the common axis P coaxial with the final transmission gear G8. The upright bracket 24L and the associated guide recess 35L are complemental in shape and, similarly, the upright bracket 24R and the associated guide recess 35R are complemental in shape. However, to avoid the possibility that the cutter holder 26 is mounted on the support base 24 in the wrong way, for example, in such a wrong way that the upright brackets 24L and 24R likely to be erroneously mated with the guide recesses 35R and 35L, respectively, a suitable alignment means is employed. In this illustrated embodiment, the alignment means comprises protrusions, each formed at 24d in the adjacent upright bracket 24L or 24R, and complementally shaped cutouts 26d formed in the respective end walls 26L and 26R of the cutter holder 26 for snugly receiving the corresponding protrusions 24d. Accordingly, the presence of the protrusions 24d renders the upright brackets 24L and 24R to represent an asymmetrical shape with respect to the mid-center line of each bracket that lies perpendicular to the common axis P and, similarly, the presence of the cutouts 26d renders the end walls 26L and 26R to represent an asymmetrical shape with respect to the mid-center line of each end wall that lies perpendicular to the common axis P.

It is to be noted that the number of the protrusions 24d as well as the number of the associated cutouts 26d may not be two such as shown and described, but only one protrusion 24d in association with one cutout 26d may be employed for the alignment means. It is also to be noted that although the protrusions 24d and the associated cutouts 26d have been shown and described as formed in the upright brackets 24L and 24R and the left and right end walls 26L and 26R, they may be reversed in position relative to each other.

Figure 18:
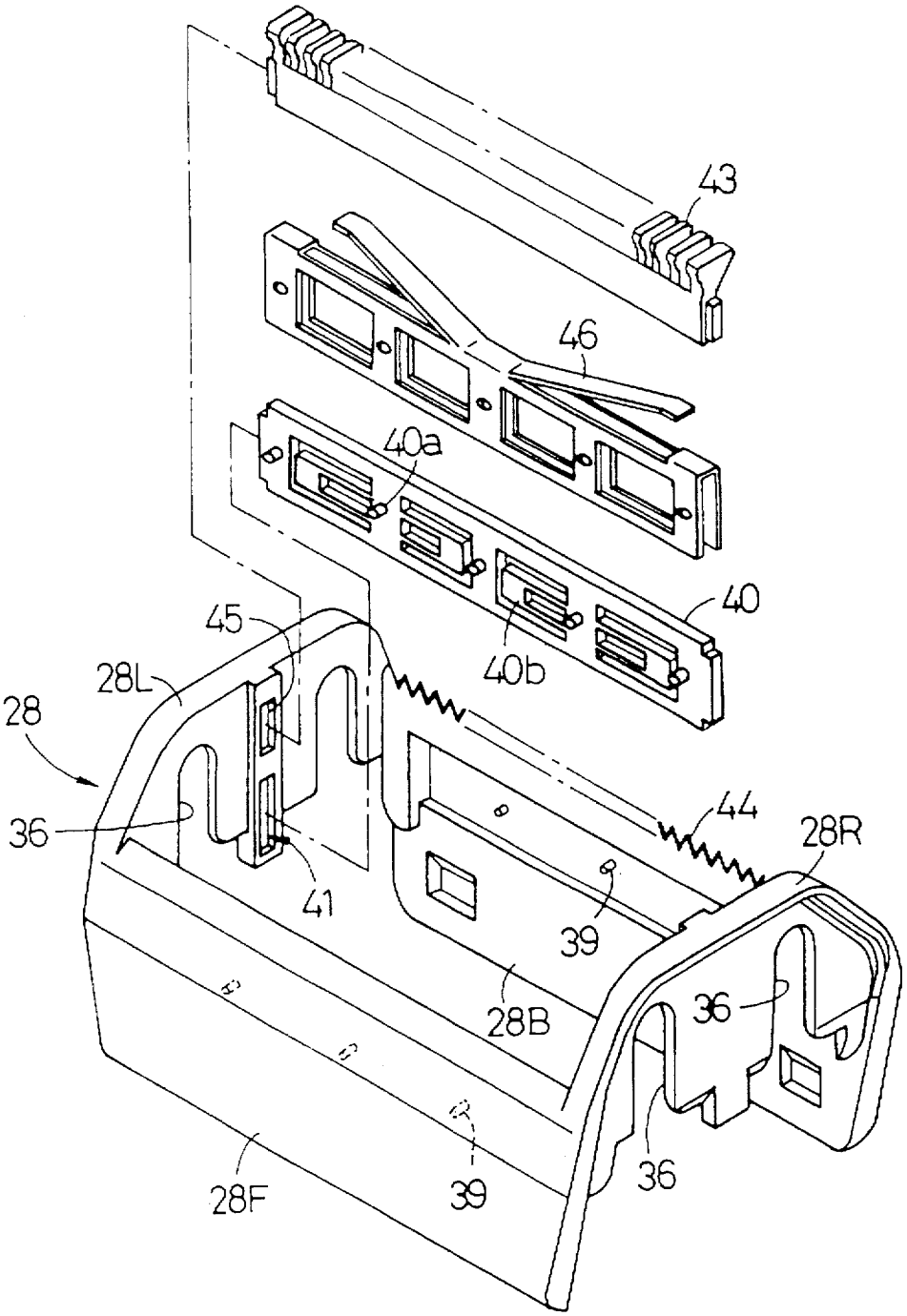
FIG. 18 is an exploded view of the stationary blade holder.

The details of the stationary blade holder 28 will now be described with particular reference to FIGS. 18 and 19. The stationary blade holder 28 comprises a cap structure of a cross-sectional shape generally similar to the shape of an inverted figure of "U" made of synthetic resin by the use of a plastics molding technique, and a stationary blade assembly mounted fixedly on the cap structure as will be described later. A portion of the cap structure corresponding to the bottom of the shape of the figure of "U", that is, a generally upwardly convexed portion of the cap structure as viewed in FIG. 18 is cut out to define a generally rectangular opening as viewed from top, thereby leaving generally rectangular front and rear walls 28F and 28B, substantially parallel to each other, and left and right end walls 28L and 28R substantially parallel to each other and substantially perpendicular to any one of the front and rear walls 28F and 28B.

Each of the end walls 28L and 28R is formed with front and rear elongated grooves 36 for receiving therein the respective left or right stud shafts of the spirally-bladed cylindrical cutters 25F and 25B when the stationary blade holder 28 is capped onto the support base 24. Also, each of the end walls 28L and 28R has an inner surface formed with upper and lower grooves 45 and 41 positioned one above the other and intermediate of the width of the associated end wall 28L or 28R as measured in a direction perpendicular to any one of the front and rear walls 28F and 28B. The lower grooves 41 in the respective end walls 28L and 28R are used to receive opposite ends of a generally rectangular intermediate anchoring piece 40.

Each of the front and rear walls 28F and 28B has an inner surface formed with a transverse row of humps 39 to which a respective side anchoring piece 37 or 38 shown in FIG. 19, as will be described subsequently, is secured by plastics rivetting or staking.

The generally rectangular anchoring pieces 37, 38 and 40, which form respective parts of the stationary blade assembly in combination with the stationary blade foils 27F and 27B, are made of plastics by the use of any suitable plastics molding technique and are utilized to secure the stationary blade foil 27F or 27B in position relative to the cap structure of the stationary blade holder 28. As can readily be understood from FIGS. 22 and 23, the rectangular anchoring pieces 37 and 38 are secured to the front and rear walls 28F and 28B of the cap structure with the humps 39 on the respective walls 28F and 28B rivetted or staked after they have passed through perforations (not shown) in the anchoring pieces 37 and 38, whereas the rectangular intermediate anchoring piece 40 is positioned generally intermediate between the anchoring pieces 37 and 38 with its opposite ends engaged in the lower grooves 41 in the respective end walls 28L and 28R.

Figure 22:
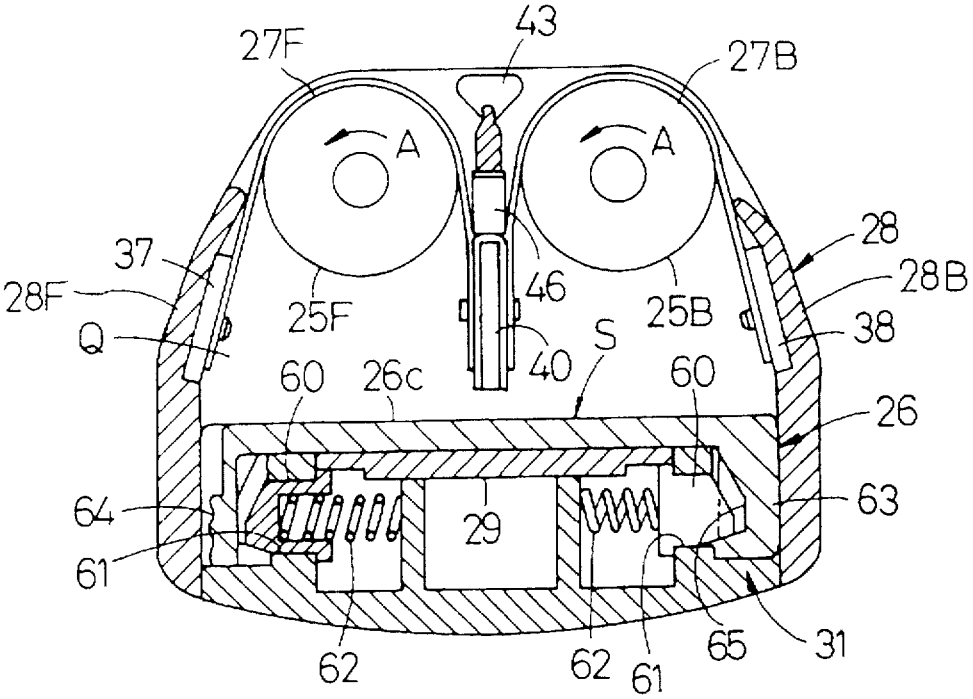
FIGS. 22 and 23 are fragmentary side sectional view of the shaving heads, showing the lock mechanisms built in the support base, respectively.
Figure 23:
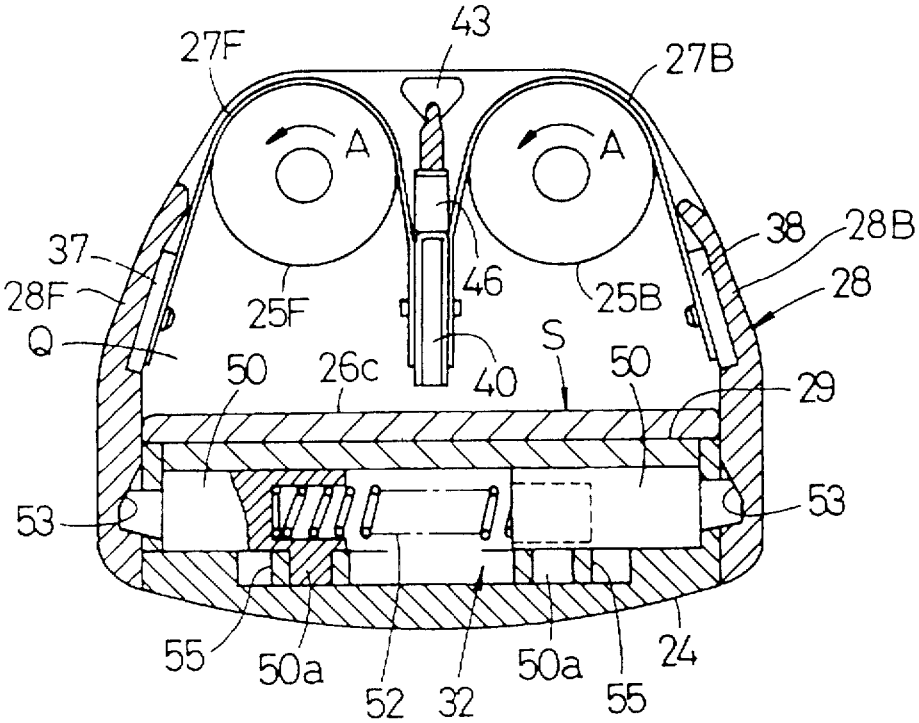

Of the anchoring pieces, the front anchoring piece 37, associated with one of opposite side edges (i.e., a front side edge) of the front stationary blade foil 27F which is positioned on a leading side with respect to the direction of rotation of the spirally-bladed cylindrical cutter 25F shown by the arrow in FIGS. 22 and 23, is slitted in a predetermined pattern at plural locations along the longitudinal sense thereof so as to leave elastically deformable tongues **37*b* each having a hump 37*c* formed therein. This anchoring piece 37 is secured to the front side edge of the front stationary blade foil 27F with the humps 37*c* rivetted or staked after they have passed through associated perforations defined in that leading side edge of the front stationary blade foil 27F**.

Similarly, the intermediate anchoring piece 40 is slitted in a similar pattern at plural locations along the longitudinal sense thereof so as to leave elastically deformable tongues **40*b* each having a hump 40*c* formed therein so as to protrude outwardly from a rear surface thereof in a direction facing the rear wall 28B. On the other hand, the intermediate anchoring piece 40 has the opposite, front surface formed with a row of humps 40*a* protruding outwardly therefrom so as to confront the front wall 28F. The rear side edge of the rear stationary blade foil 27F opposite to the front anchoring piece 37 is secured to the front surface of the intermediate anchoring piece 40 with the humps 40*a* rivetted or staked after they have passed through associated perforation defined in said rear side edge of the front stationary blade foil 27F, thereby completing securement of the front and intermediate anchoring pieces 37 and 40 to the front and rear side edges of the front stationary blade foil 27F**, respectively.

The rear stationary blade foil 27B has its opposite side edges formed with respective rows of perforations. The rear anchoring piece 38 is secured to the rear side edge of the rear stationary blade foil 27B with the humps **38*a* rivetted or staked after they have passed through the perforations in the rear side edge of the rear stationary blade foil 27B. Similarly, the front side edge of the rear stationary blade foil 27B is secured to the intermediate anchoring piece 40 with the humps 40*c* rivetted or staked after they have passed through the perforations in the front side edge of the rear stationary blade foil 27B**.

The stationary blade assembly of the structure described above is received in the cap structure with the front and rear anchoring pieces 37 and 38 rivetted to the front and rear walls 28F and 28B, respectively, and with the intermediate anchoring piece 40 engaged at its opposite ends into the lower grooves 41 in the end walls 28L and 28R, respectively. In this assembled condition of the stationary blade holder 28 with the stationary blade assembly received in the cap structure, the front and rear stationary blade foils 27F and 27B are outwardly curved to follow the respective curvatures of the front and rear spirally-bladed cylindrical cutters 25F and 25B and are at the same time held in sliding contact with blade tips of the front and rear spirally-bladed cylindrical cutters 25F and 25B.

Considering that the respective rear side edges of the front and rear stationary blade foils 27F and 27B, which are situated on a trailing side with respect to the direction of rotation of the spirally-bladed cylindrical cutters 25F and 25B as indicated by the arrows A in FIGS. 22 and 23, are fixed in position to the intermediate and rear anchoring pieces 40 and 38 whereas the front side edges of the front and rear stationary blade foils 27F and 27B on a leading side with respect to the direction of rotation of the spirally-bladed cylindrical cutters 25F and 25B are secured to the front and intermediate anchoring pieces 37 and 40 through the elastically deformable tongues **37*b* and 40*b* integral respectively with the front and intermediate anchoring pieces 37 and 40, mounting of the stationary blade assembly on the cap structure to complete the stationary blade holder 28 and subsequent mounting of the stationary blade holder 28 on the cutter holder 26 to thereby complete the cutter unit 3 as shown in FIGS. 22 and 23 results in that the front and rear stationary blade foils 27F and 27B are tensioned in contact with the associated spirally-bladed cylindrical cutters 25F and 25B with the elastically deformable tongues 38*b* and 40*b* consequently held in prestressed conditions having been deformed in a direction counter to the direction of rotation of the spirally-bladed cylindrical cutters 25F and 25B**.

It is to be noted that the respective front side edges of the front and rear stationary blade foils 27F and 27B may be fixedly secured directly to the front and intermediate anchoring pieces 37 and 40 in a manner substantially similar to the connection between the rear side edges thereof with the intermediate and rear anchoring pieces 40 and 38. However, considering that during rotation of the spirally-bladed cylindrical cutters 25F and 25B in the same direction shown by the arrows A with a frictional resistance developing between the spirally-bladed cylindrical cutters 25F and 25B and the associated stationary blade foils 27F and 27B and, also during the actual use of the electric shaver of the present invention, a friction is developed between the facial skin of the user and the stationary blade foils 27F and 27B, leading or front side portions of the stationary blade foils 27F and 27B adjacent the front and intermediate anchoring pieces 37 and 40 will be barely slackened. Accordingly, the use of the elastically deformable tongues **38*b* and 40*b* through which the front side edges of the stationary blade foils 27F and 27B are secured to the front and intermediate anchoring pieces 37 and 40, respectively, is particularly advantageous in that any possible slack occurring in the leading or front side portions of the stationary blade foils 27F and 27B adjacent the front and intermediate anchoring pieces 37 and 40 can be absorbed to facilitate constant sliding contact between the blade foils 27F and 27B and the associated cylindrical cutters 25F and 25B, as the elastically deformable tongues 37*b* and 40*b*** once deformed restore to their original shape, to thereby ensure a smooth and constant shaving performance.

It is to be noted that although in the embodiment described so far the electric shaver is of the twin-cutter type employing the two spirally-bladed cylindrical cutters in combination with the two stationary blade foils, the present invention can equally be applied to an electric shaver of a single cutter type employing only one spirally-bladed cylindrical cutter in combination with only one stationary blade foil and also to that of a triple type employing three spirally-bladed cylindrical cutters in combination with only one stationary blade foil. In this single or triple cutter design, the intermediate anchoring piece 40 and either one of the stationary blade foils 27F and 27B may be dispensed with.

Figure 19:
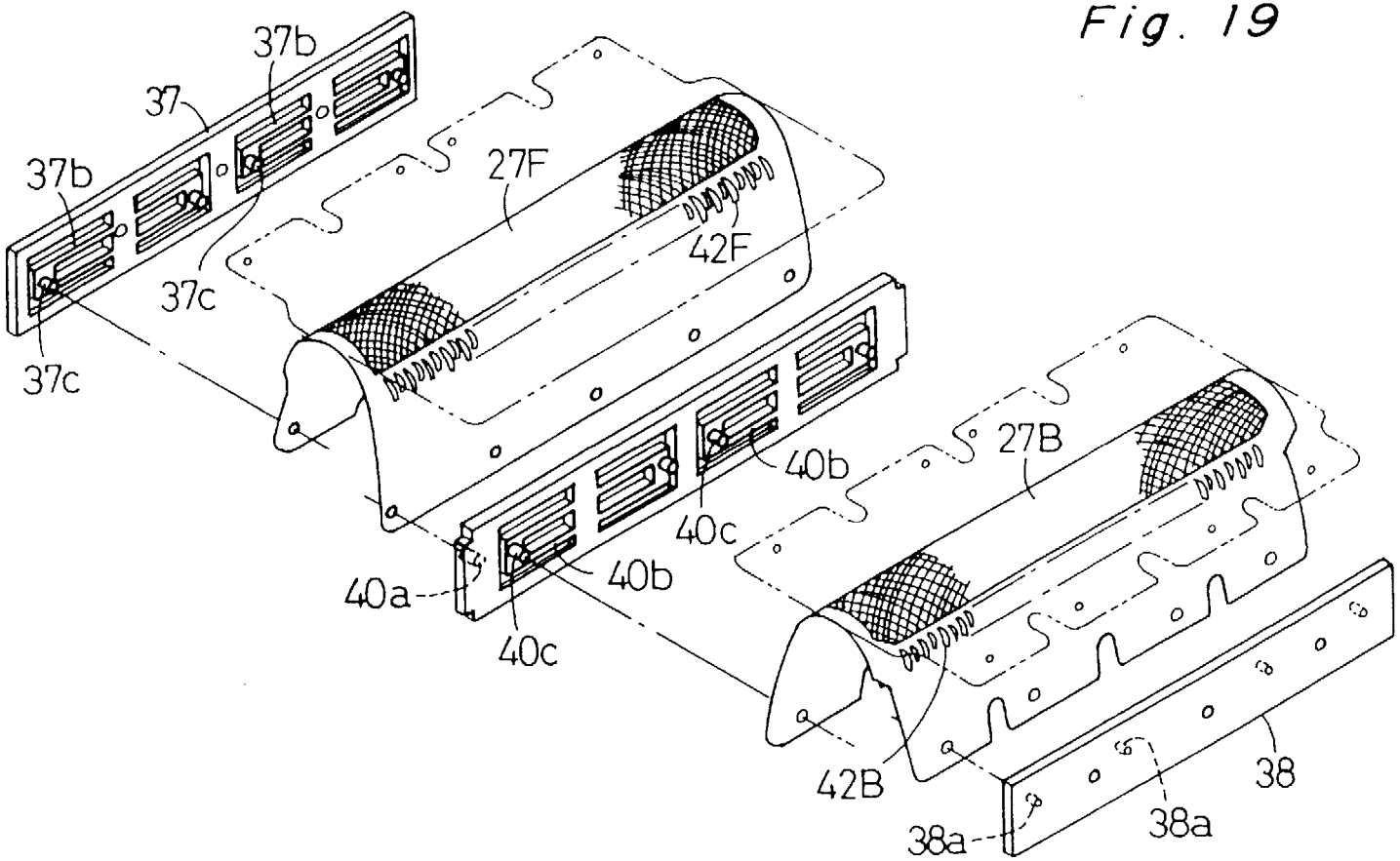
FIG. 19 is an exploded view of the stationary blade assembly.

Referring still to FIG. 19, since the front and rear stationary blade foils 27F and 27B are of a substantially identical construction, reference will be made to only one of them, for example, the stationary blade foil 27F. As shown therein, the stationary blade foil 27F has a generally rectangular perforated region having a multiplicity of fine perforations defined therein and a row of slits 42F (or 42B) defined along a rear side edge of the rectangular perforated region, each of said slits 42F (or 42B) being oriented in a direction conforming to the direction of rotation of the associated spirally-bladed cylindrical cutter. The row of the slits 42F (or 42B) are positioned on the trailing side with respect to the direction of rotation of the associated spirally-bladed cylindrical cutter. The row of the slits 42F (or 42B) are used to positively guide, relatively long hairs inwardly of the associated stationary blade foil to cut them the first thing before the hairs subsequently plunge into the fine perforations as the electric shaver is advanced along the facial skin.

The stationary blade assembly also includes, as best shown in FIGS. 18, 22 and 23, a generally elongated comb member 43 for tidying relatively long hairs to facilitate entry of the long hairs into the slits 42F in the front stationary blade foil 27F. This comb member 43 is made of plastics and is positioned between the front and rear stationary blade foils 27F and 27B and above the intermediate anchoring piece 40 with its opposite ends snugly received in the associated upper grooves 45 in the end walls 28L and 28R of the cap structure. This comb member 43 so mounted is normally biased upwardly by a leaf spring member 46 capped onto the intermediate side piece 40 to allow the comb member 43 to accomplish a positive contact with the facial skin to tidy the hairs being shaved. Also for guiding the relatively long hairs so as to plug into the slots 42B in the rear stationary blade foil 27B, the rear walls 28B of the stationary blade holder 28 has an upper edge adjacent the rear stationary blade foil 27B formed with parallel corn grooves 44.

The details of the releasable lock mechanism 32 for the stationary blade holder 28 will now be described with particular reference to FIGS. 20 to 23.

As described previously, the support base 24 is of a generally rectangular box-like configuration having a rectangular cavity closed by a rectangular lid 29 snap-fitted thereto. This rectangular cavity is delimited by, in addition to the lid 29 and the opposite end walls where the left and right upright brackets 24L and 24R are formed, front and rear side walls and a bottom wall. The front and rear side wall of the support base 24 are formed with respective pairs of generally square openings generally identified by 51, the square openings 51 of each pair being positioned adjacent the left and right side walls thereof. Engagement pawl members 50 are accommodated within the cavity for movement in a direction away from and towards each other between retracted and projected positions and are normally biased towards the projected position by the action of respective compression springs 52 interposed between the engagement pawl members 50. So long as they are normally biased to the projected position, the engagement pawl members 50 protrude partially outwardly of the support base 24 through the associated square openings 51 with their pawls engaged in corresponding engagement recesses 53 which are defined in respective inner surfaces of the front and rear walls 28F and 28B of the stationary blade holder 28 to thereby lock the stationary blade holder 28 in a position mounted on the support base.

Within the cavity in the support base 24, rocking links 55 are pivotally mounted at an intermediate portion thereof on an upright bearing pin 54 formed on the bottom wall, and are arranged in a generally X-shaped shape. The rocking links 55 have their opposite ends formed with catch holes **55*a* defined therein, and pins 50*a* integral with and extending downwardly from the engagement pawl members 50 are rotatably engaged respectively in those catch holes 55*a* in the rocking links 55**.

Figure 21:
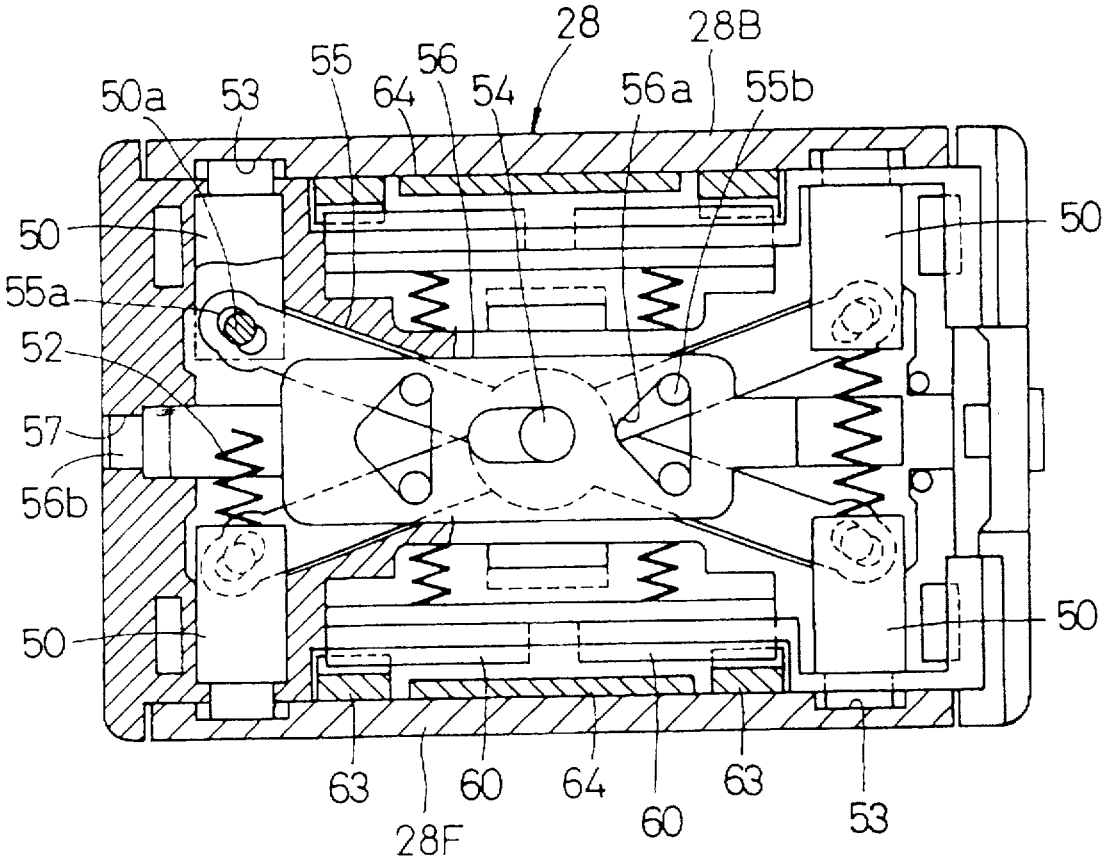
FIG. 21 is a sectional view, as viewed from top, of the support base shown in FIG. 20.

A generally elongated release lever 56 having generally triangular cam holes **56*a* defined therein so as to orient in a direction conforming to each other and in a direction lengthwise of the release lever 56 is loosely mounted on the bearing pin 54 and positioned above the rocking links 55 with the triangular holes 56*a* receiving therein respective cam follower pins 55*b* integral or rigid with the rocking pins 55. So long as the stationary blade holder 28 is mounted on the support base 24 and locked in the mounted position with the engagement pawl members 50 held at the projected position biased by the associated compression springs 52, the cam follower pins 55*b* integral or rigid with the rocking links 55 occupy their respective positions corresponding to opposite ends of the base of the triangle shape represented by the cam holes 56*a* as best shown in FIG. 21. However, when the release lever 56 is moved rightward as viewed in FIG. 21, the cam follower pins 55*b* slidingly move along portions of the cam poles 56*a*, which correspond to sides of the triangle shape, towards respective apex regions of the cam holes 56*a*, accompanied by pivotal motion of the rocking links 55 towards a folded position which in turn results in movement of the engagement pawl members 50 from the projected position towards the retracted position against the compression springs 52. Accordingly, the rightward movement of the release lever 56 results in release of the stationary blade holder 28** from the mounted position.

The release lever 56 operable in the manner described above is accessible to the user of the electric shaver. For this purpose, a left end **56*b* of the release lever 56 extends into a hole 57 defined in the left end wall of the support base 24 to such an extent that when the stationary blade holder 28 is locked in the mounted position a free end face of the left end 56*b* of the release lever 56 is substantially flush with an outer surface of the left end wall of the support base 24. On the other hand, a lock release button 58 extends axially slidably through the plate-like cap 22L, then through the cover plate 21L and finally through the upright walls 15L of the head casing 11 as shown in FIGS. 8 and 9 with an outer end thereof exposed to the outside for access by the user's finger and with an inner end alignable with the hole 57**.

As hereinbefore described, the cutter unit 3 including the support base 24, the stationary blade assembly and the cutter holder 26 with the spirally-bladed cylindrical cutters 25F and 25B thereon can swing about the common axis P between forward and rearward positions. The lock release button 58 axially slidably supported in the manner described above is aligned with the hole 57 and, hence, the left end **56*b* of the release lever 56 when the cutter unit 3 is moved to a position generally intermediate of the stroke of swing of the cutter unit 3 and, therefore, while the lock release button 58 is aligned with the left end 56*b* of the release lever 56, the user has to push the lock release button 58 towards the release lever 56 to release the stationary blade holder 28 from the mounted position relative to the support base 24**.

Locking of the stationary blade holder 28 at the mounted position can simply be accomplished merely by pushing the stationary blade holder 28 to mount on the support base 24 until the engagement pawl members 50 are inwardly urged in contact with the end walls 28L and 28R of the stationary blade holder 28 and are subsequently instantaneously snapped in the associated engagement recesses 53 by the action of the compression springs 52.

The details of the releasable lock mechanism 31 for the cutter holder 26 will now be described with particular reference to FIGS. 20 to 22. The front and rear side wall of the support base 24 are also formed with respective pairs of generally rectangular openings 61, the rectangular openings 61 of each pair being positioned between the square openings 51 of the associated pair as best shown in FIG. 20. Pawl members 60 are accommodated within the cavity for movement in a direction away from and towards each other between retracted and projected positions and are normally biased towards the projected position by the action of respective compression springs 62 interposed between the pawl members 60. So long as they are normally biased to the projected position, the pawl members 60 protrude partially outwardly of the support base 24 through the associated rectangular openings 61 so that pawls of the pawl members 60 can be engaged in corresponding engagement recesses 65, which are defined in associated bulges 63 formed integrally with the head casing 11 so as to depend downwardly therefrom, to thereby lock the cutter holder 26 in a position mounted on the support base 24. A thin-walled, elastically deformable knob region 64 is also integrally formed with the head casing 11 so as to depend downwardly therefrom and positioned between each of the front or rear pair of the bulges 63.

The releasable lock mechanism 31 is so designed and so structured that when a pushing force is applied to the knob regions 64 so as to cause the latter to be inwardly deflected against their own elasticity while the cutter holder 26 is locked in the mounted position as shown in FIGS. 21 and 22, the compression springs 62 are axially inwardly compressed to allow the pawl members 60 to be inwardly moved to the retracted position to thereby release the cutter holder 26 from the mounted position.

Locking of the cutter holder 26 at the mounted position can simply be accomplished merely by pushing the cutter holder 26 to mount on the support base 24 until the pawl members 60 are inwardly urged against the compression springs 62 and are subsequently instantaneously snapped in the associated engagement recesses 65 in the bulges 63 by the action of the compression springs 62.

Figure 32:
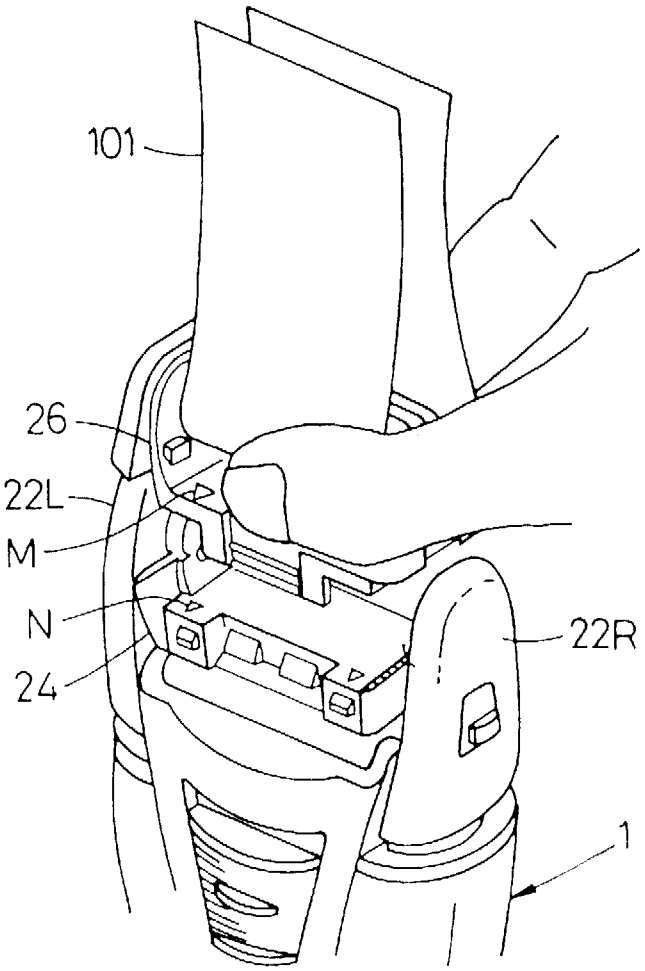
FIGS. 31 and 32 are explanatory diagrams showing how the cutter unit is removed from the support base and how the cutter unit once removed is remounted, respectively.
Figure 31:
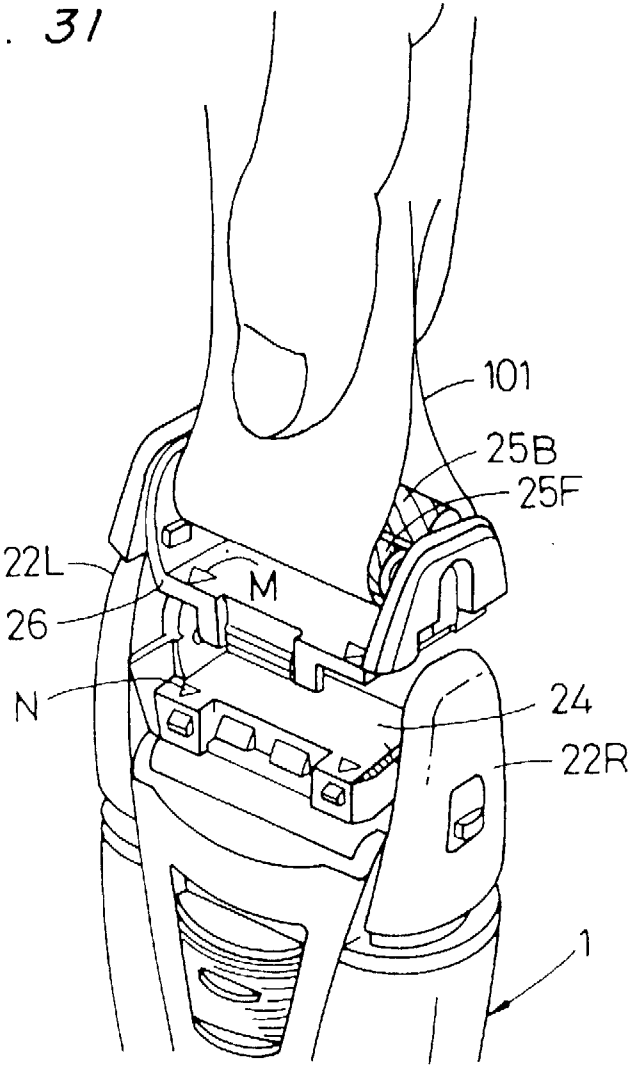

Replacement of the spirally-bladed cylindrical cutters 25F and 25B with fresh spirally-bladed cylindrical cutters is accomplished by replacement of the cutter holder 26 with a new cutter holder. This is because the cutter holder 26 employed in the practice of the present invention is not of a design not recommended for the user to dismantle it. In any event, when the cutter holder 26 is to be removed from the support base 24, the use is recommended of a flexible blade protective strip 101 made of paper or any other suitable material such as, for example, fabric as shown in FIGS. 31 and 32. In using such protective strip 101, the user must pass it underneath the spirally-bladed cylindrical cutters 25F and 25B until opposite ends thereof are brought together, and pull the overlapping ends of the strip 101 upwardly in a direction generally perpendicular to the support base 24. By so doing, risk of the user's fingers being cut by the spiral blades can advantageously minimized.

Conversely, when the cutter holder 26 with the spirally-bladed cylindrical cutters 25F and 25B thereon is to be mounted on the support base 24, the protective strip 101 has to be passed underneath the spirally-bladed cylindrical cutters 25F and 25B. The user should then grip the spirally-bladed cylindrical cutters 25F and 25B from opposite directions through different portions of the protective strip 101 as shown in FIG. 32 and push them against the support base 24 to allow the cutter holder 26 as a whole to be mounted onto the support base 24.

As indicated previously, the alignment means in the form of the alignment protrusions **24*d* in combination with the mating alignment cutouts 26 is employed for avoiding the possibility that the cutter holder 26 is mounted on the support base 24 in the wrong way. However, in order to provide a visual indication by which the user can ascertain if the cutter holder 26 is properly mounted on the support base, alignment markings M and N such as, for example, arrow indicia are formed in any suitable manner on the cutter holder 26 and the lid 29 of the support base 24 as shown in FIGS. 31 and 32. Thus, by aligning those markings M and N, the user can properly mount the cutter holder 26 on the support base 24**.

Figure 24:
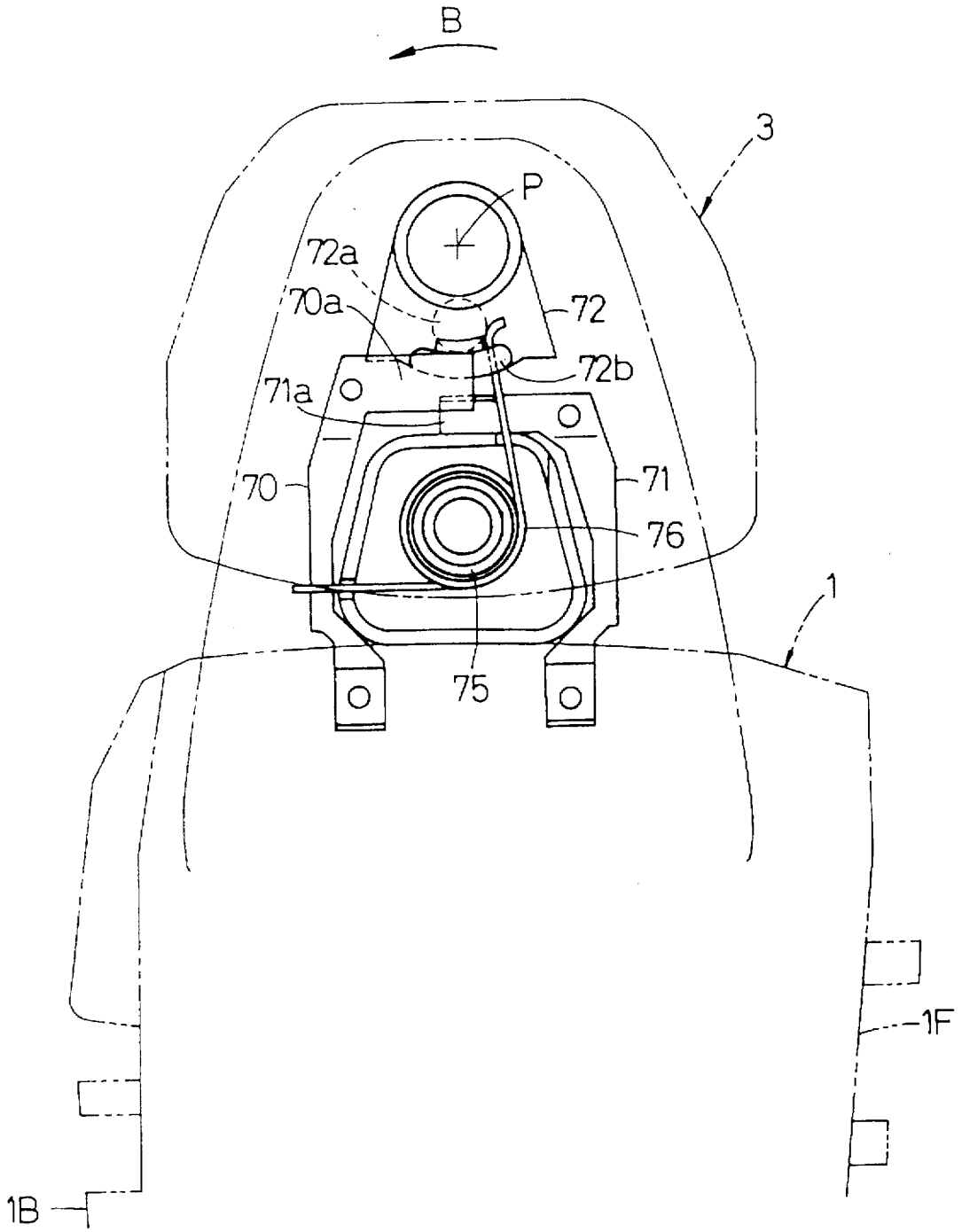
FIG. 24 is a fragmentary side view of the top portion of the electric shaver, showing a safety switch mechanism employed therein.
Figure 25:
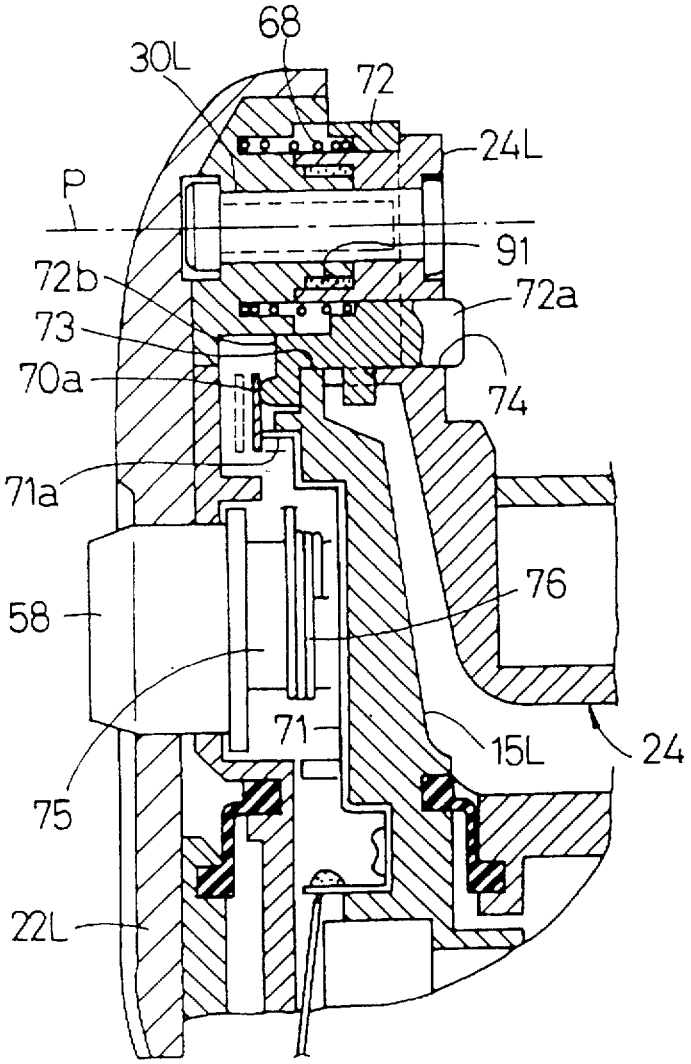
FIG. 25 is a fragmentary front sectional view of the top portion of the electric shaver, showing the details of the safety switch mechanism.
Figure 30:
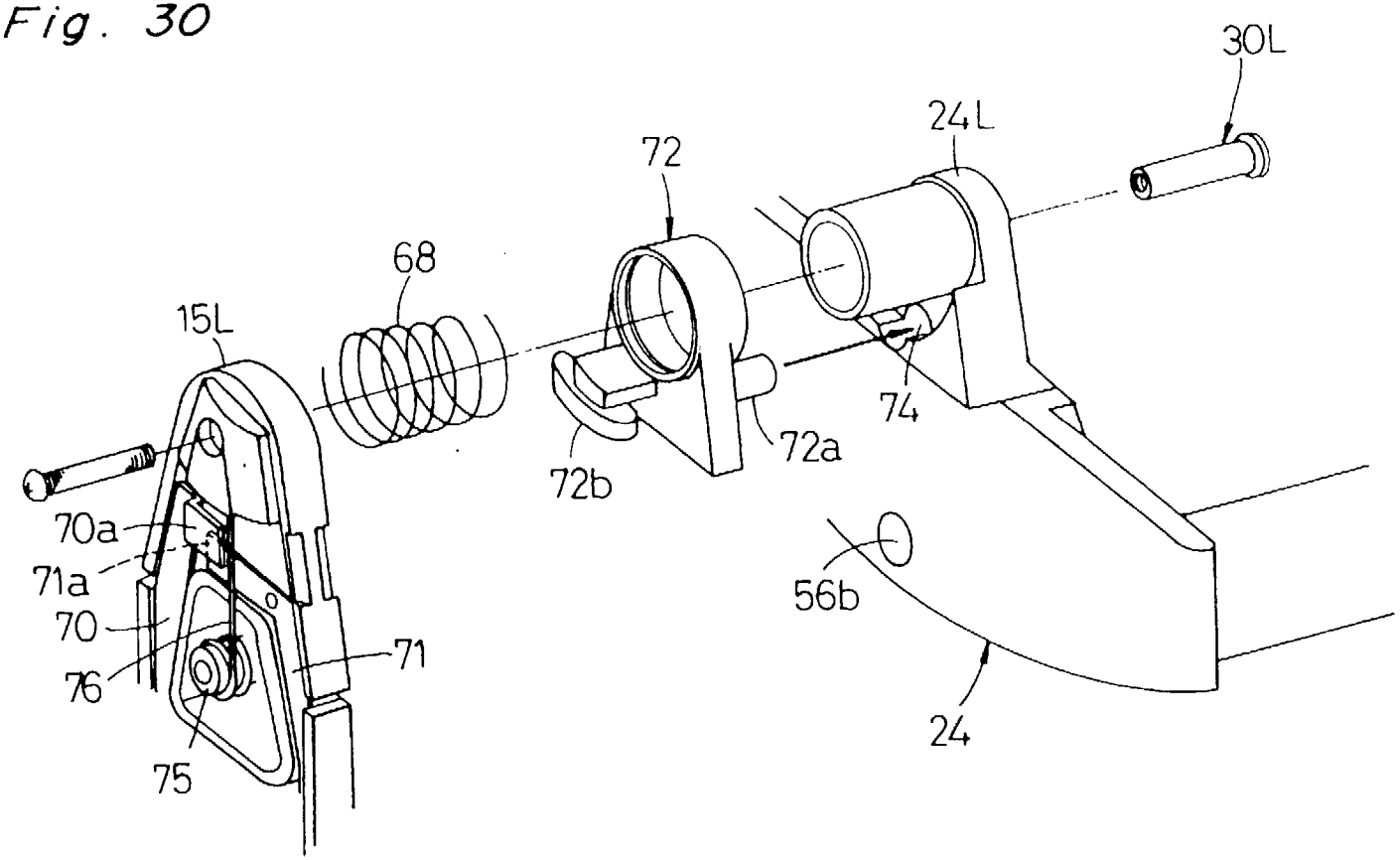
FIG. 30 is an exploded view, on an enlarged scale, showing the details of the safety switch mechanism.

The electric shaver embodying the present invention is provided with a safety switch mechanism for opening the electric circuit between the power source and the drive motor 14 upon removal of the stationary blade holder 28 for safety purpose. This safety switch mechanism is best shown in FIGS. 24, 25 and 30. As shown therein, terminal strips 70 and 71 made of electroconductive metal by the use of any known punching technique are secured to an outer surface of the upright wall 15L of the head casing 11 with respective upper ends **70*a* and 71*a* held in overlapping contact with each other. The opposite lower ends of the terminal strips 70 and 71 are electrically connected with the power source through a main switch by way of a control circuit on the printed circuit boards 4, whereas the upper ends 70*a* and 71*a* thereof are normally held in contact with each other to close an electric circuit between the terminal strips 70 and 71 to thereby cause the control circuit to interrupt the supply of an electric power to the drive motor 14**.

The upright wall 15L of the head casing 11 carries a generally triangular actuator piece 72 positioned between the upright wall 15L and the upright bracket 24L integral with the support base 24 for pivotal movement together with the support base 24 and also for axial displacement in a direction parallel to the common axis P. Specifically, as best shown in FIG. 30, the triangular actuator piece 72 is formed integrally with a generally arcuate projection **72*b* that is, during the pivotal movement of the triangular actuator piece 72 about the common axis P, guided within a correspondingly shaped arcuate slot 73 (See also FIG. 13) defined in the upright wall 15L. A compression spring 68 is interposed coaxial with the common axis P between the upright wall 15L and the actuator piece 72 to bias the latter towards the upright bracket 24L of the support base 24**.

The upright bracket 24L of the support base 24 is formed with a round through-hole 74 in which an actuating pin **72*a* formed integrally with the actuator piece 72 so as to protrude in a direction counter to the arcuate projection 72*b* is axially movably engaged so that the actuator piece 72 can swing together with the support base 24 about the common axis P defined by the pivot shafts, only one of which is shown by 30L in FIG. 30. It is to be noted that while the actuator piece 72 is axially displaceable between the upright wall 15L and the upright bracket 24L, the actuating pin 72*a* has an axial length so chosen as to allow a free end thereof to protrude a slight distance into a space between the left and right upright bracket 24L so long as the actuator piece 72 is biased by the compression spring 68, but to allow the free end thereof to retract inwardly of the through-hole 74 when the actuator piece 72 is axially displaced against the compression spring 68**.

The actuator piece 72 can be axially displaced in a direction towards the upright wall 15L against the compression spring 68 when the stationary blade holder 28 is capped onto the support base 24. This is because as the stationary blade holder 28 is capped onto the support base 24, the left end wall 28L of the stationary blade holder 28 is brought into contact with the free end of the actuating pin **72*a*, causing the actuator piece 72 to displace axially against the compression spring 68. When the actuator piece 72 is so displaced towards the upright wall 15L, the arcuate projection 72*b* integral with the actuator piece 72 deforms the upper end 70*a* of the terminal strip 70 against its own resiliency to thereby cause it to separate from the upper end 71*a* of the terminal strip 71 to initiate the supply of the electric power to the drive motor 14. In other words, so long as the stationary blade holder 28 is mounted on the support base 24, and when the switch knob 7 is moved to the ON position, the drive motor 14 can be electrically powered. Conversely, when the stationary blade holder 28 is removed from the support base 24, the actuator piece 72 is axially biased towards the upright bracket 24L as biased by the compression spring 68 with the upper end 70***a* of the terminal strip 70 consequently brought into contact with the upper end 71*a* of the terminal strip 71 and, therefore, the drive motor 14 cannot be electrically powered even though the main switch knob 7 is in the ON position.

Figure 27:
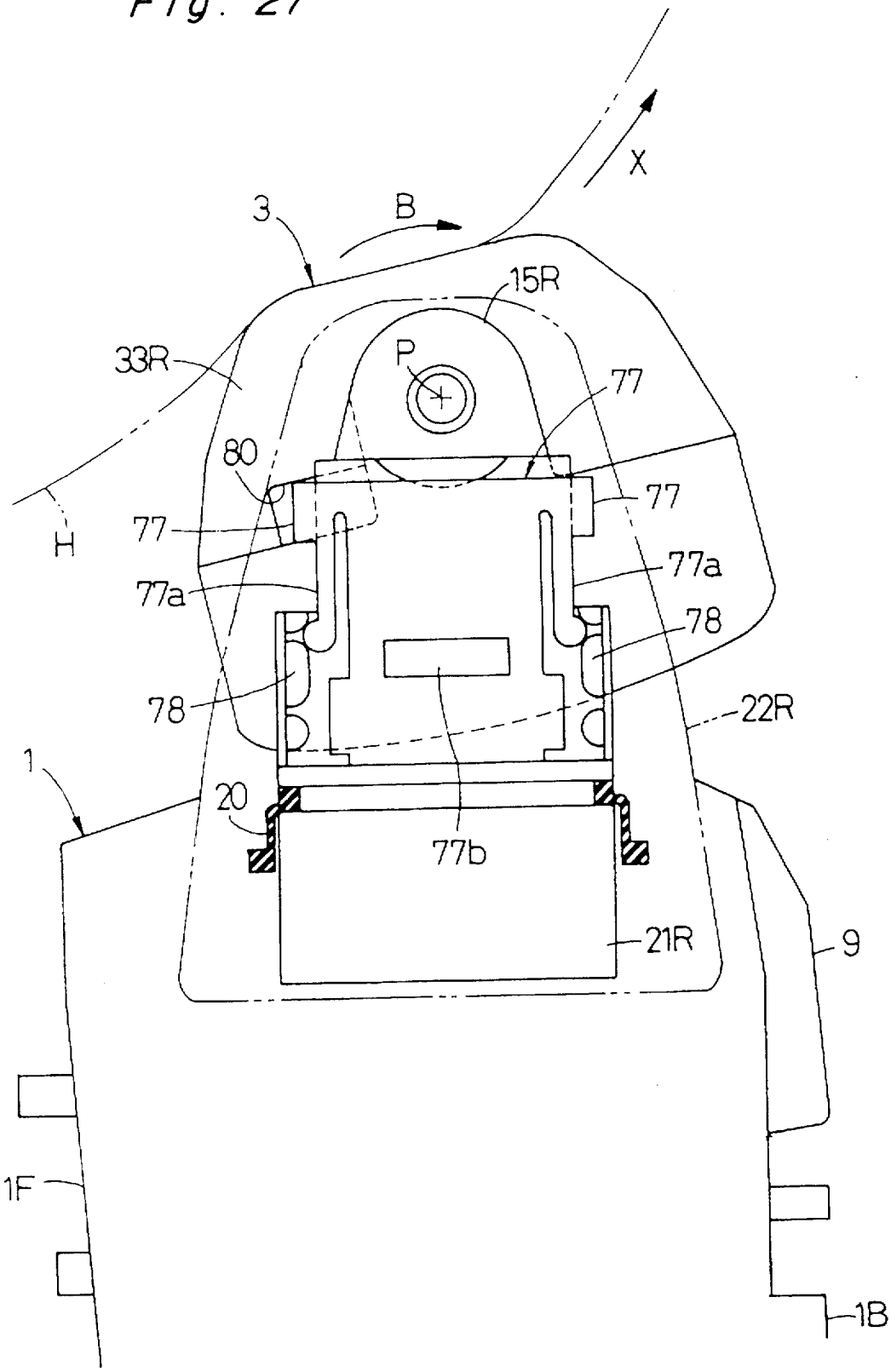

According to the electric shaver of the construction described hereinbefore, only the cutter unit 3 can swing back and forth about the common axis P coaxial with the final transmission gear G8 of the drive transmitting gear train 23 relative to the cutter head 2 including the drive motor 14 and the drive transmitting gear train 23, to thereby allow the cutter unit 3 to follow the contour of the user's face. Specifically, as shown in FIG. 27, when in use, it is generally recommended to move the electric shaver upwardly along the facial skin H in a direction shown by the arrow X while the user holds the electric shaver with the rear casing half 1B oriented away from the body of the user and with the cutter unit 3 held in contact with the facial skin H. When the electric shaver is so moved with the cutter unit 3 held in sliding contact with the facial skin H, the cutter unit 3, a reactive force acts from the facial skin H to the cutter unit 3 which would cause the cutter unit 3 to swing forward in a direction indicated by the arrow A to separate away from the facial skin H. However, if at this time the cutter unit 3 is held at a position tilted forward from a neutral position, the cutter unit 3 is caused to swing back in a direction indicated by the arrow B about the common axis P by the action of a frictional force, which is transmitted from the final transmission gear G8 to the right upright bracket 24R of the support base 24 then held in contact with a surface of the final transmission gear G8, and a slide reactive force which the stationary blade foils 27F and 27B receive from the spirally-bladed cylindrical cutters 25F and 25B then being rotated forwards as viewed from the position of the user (i.e., in a direction counter to the direction X along which the electric shaver is moved). This urges the cutter unit 3 to positively contact the facial skin H to thereby increase the consistency of the cutter unit 3 relative to the facial skin to accomplish a sharp shaving.

Where the cutter unit 3 is tilted rearwardly from the neutral position, a spring element 76, for example, a torsion spring, may be employed to forcibly return the cutter unit 3 in the direction of the arrow B to cause the cutter head 3 to assume the neutral position by the effect of a resilient reactive force of the spring element 76. Where the torsion spring 76 is employed, a coiled body of the torsion spring 76 should be mounted on a support post 75 for passage therethrough of the lock release button 58 at a left portion of the cutter head 2 with a free end thereof engaged to a front end of the arcuate projection 72*b* of the actuator piece 72 which moves together with the cutter unit 3, as shown in FIG. 24.

Figure 26:
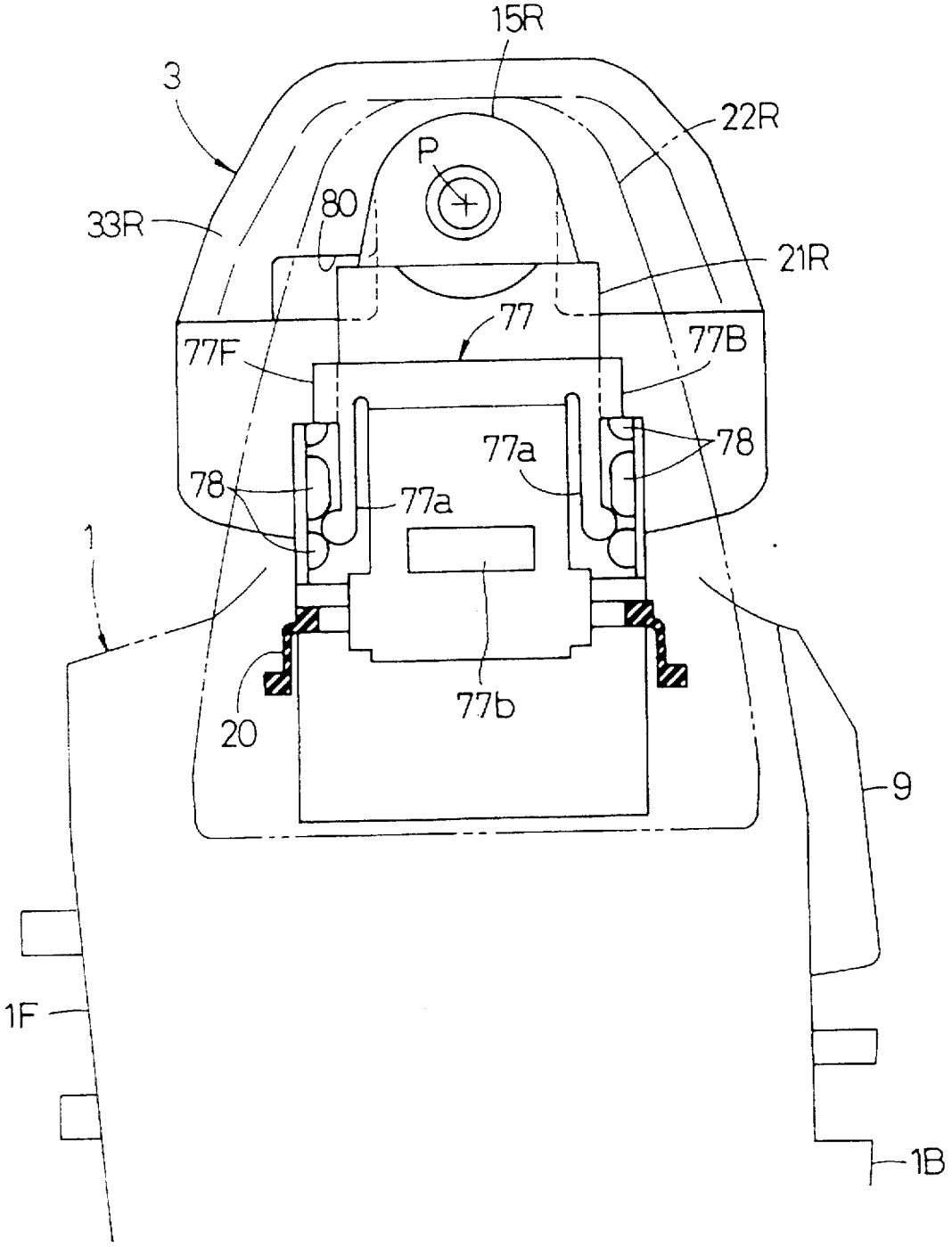
FIGS. 26 and 27 are schematic side sectional views of the top portion of the electric shaver, showing the cutter unit in locked and swingable positions, respectively.
Figure 28:
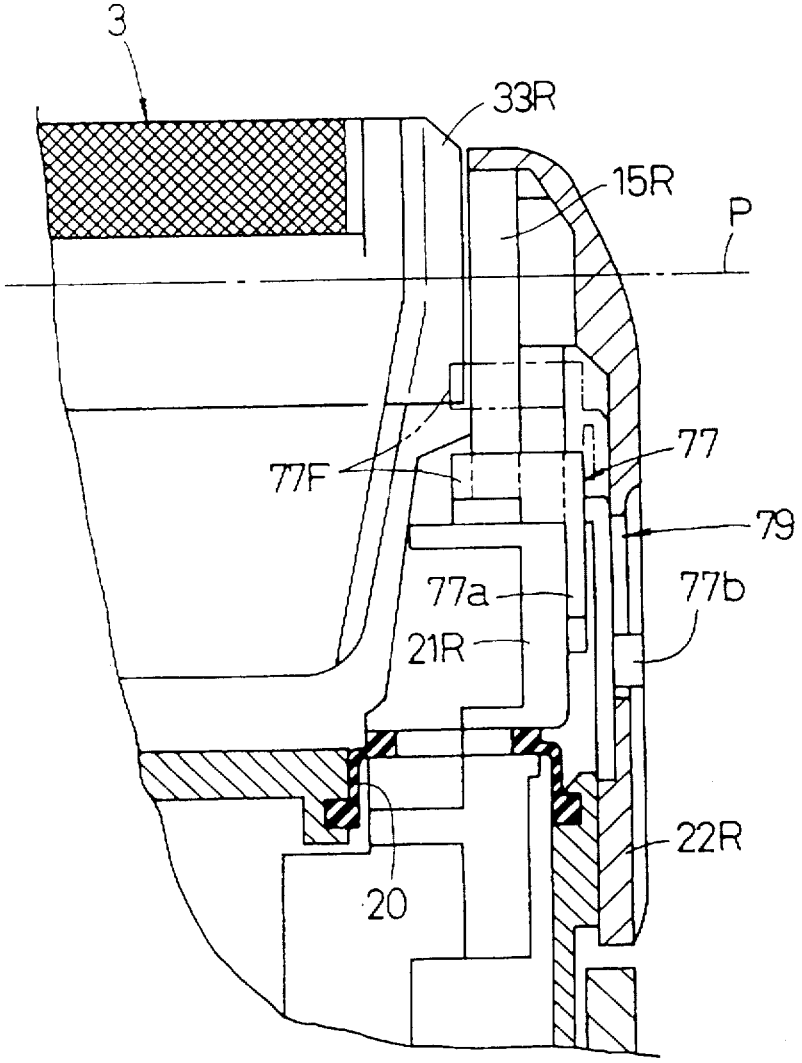
FIG. 28 is a fragmentary front sectional view of the top portion of the electric shaver, showing a swing lock mechanism employed in the electric shaver.
Figure 29:
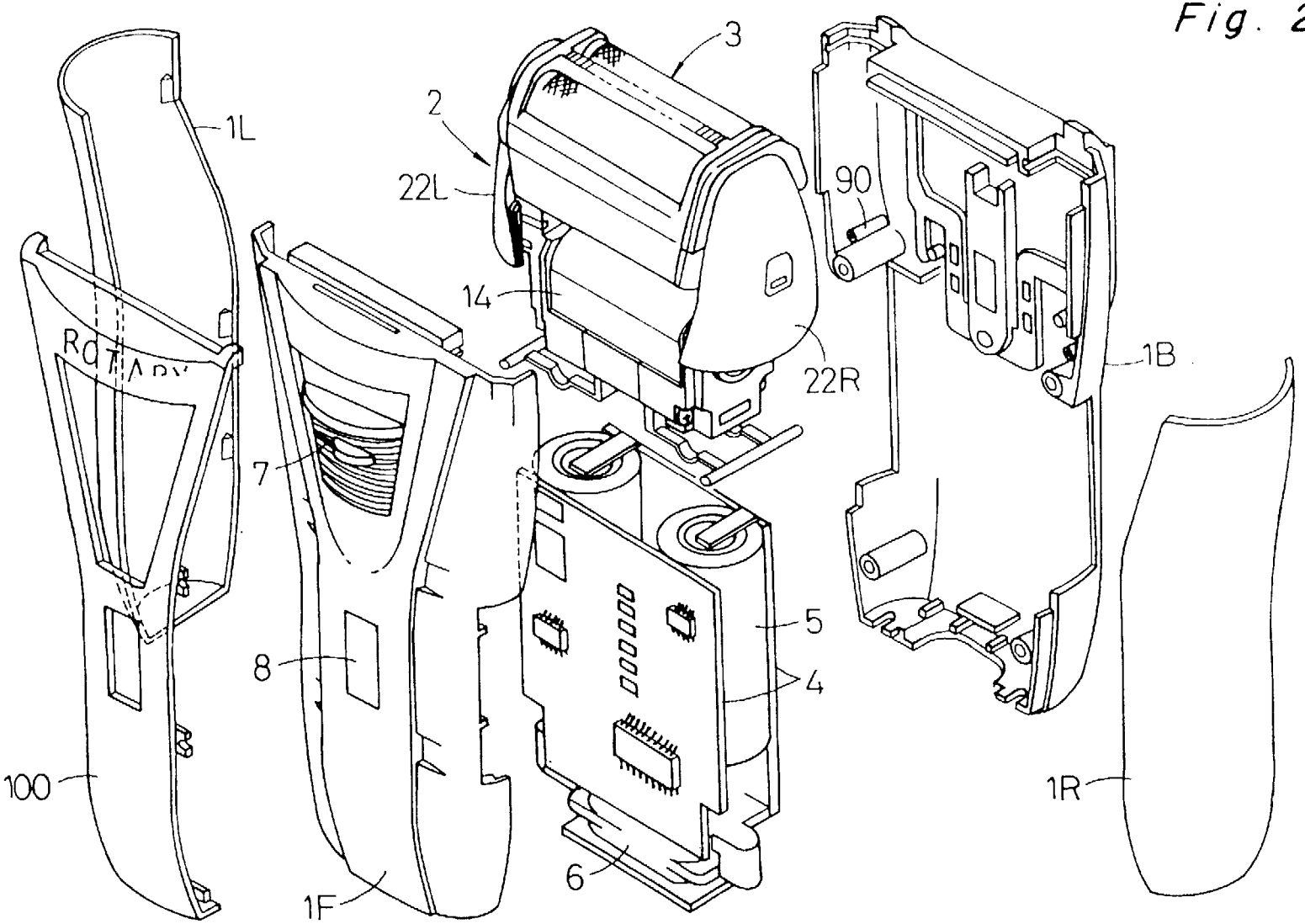
FIG. 29 is an exploded view of the electric shaver according to the present invention.

As a means for slowing the swinging motion, in the direction of the arrow B, of the cutter unit 3, then held at a forward tilted position by the action of the frictional force transmitted from the final transmission gear G8 and the slide reactive force which the stationary blade foils 27F and 27B receive from the spirally-bladed cylindrical cutters 25F and 25B, a grease reservoir 91 is formed, as shown in FIG. 25, between a boss in the upright wall 15L, through which the pivot shaft 30L extends, and a boss in the upright bracket 24L coaxial with the boss in the upright wall 15L. A quantity of highly viscous grease is filled in this grease reservoir 91 to lessen the swinging motion of the cutter unit 3.

Where hairs on the upper lip are desired to be shaved, fixing in position of the cutter unit 3 is desirable. Therefore, a lock mechanism for fixing the cutter unit 3 relative to the cutter head 2 is employed and is disposed in the right upright wall 15R integral with the head casing 11. As shown in FIGS. 26 to 28, the cutter lock mechanism includes a slide member 77 slidable between locked and released position in a direction generally parallel to the longitudinal sense of the right upright wall 15R integral with the head casing 11. The slide member 77 includes front and rear arms 77F and 77B, functionally corresponding to opposite ends of a C-clip, and is fitted exteriorly to the right cover plate 21R with the arms 77F and 77B substantially embracing the right cover plate 21R. As hereinbefore described, the right cover plate 21R is in turn fitted to the right upright wall 15R integral with the head casing 11.

To impart a click sensation to the sliding movement of the slide member 77 as the latter is moved to any one of the locked and released positions, the slide member 77 also includes elastically yieldable arms 77*a* integrally formed therewith so as to extend in a direction perpendicular to the arms 77F and 77B and parallel to the direction of movement of the slide member 77, each of said elastically yieldable arms 77*a* having a free end formed with a detent protuberance. On the other hand, the right cover plate 21R has its opposite side edge portions formed with a plurality of, for example, three, projections 78 that define detent recesses corresponding in position to the locked and released positions, respectively, of the slide member 77. Thus, it will readily be understood that as the slide member 77 is moved between the locked and released positions, the detent protuberances at the respective free ends of the elastically yieldable arms 77*a* is selectively engaged in any one of the detent recesses to lock the slide member 77 at the corresponding locked or released position.

In order for the cutter unit 3 to be locked in position when the slide member 77 is moved upwardly to the locked position, each of the arms 77F and 77B has a length so chosen that when the slide member 77 is in the locked position as shown by the phantom line in FIG. 28, a respective free end thereof is held in position protruding into the path of movement of the flat cap 33R fast with the cutter holder 26. Accordingly, when the slide member 77 is in the locked position, the free ends of the arms 77F and 77B interfere with the flat cap 33R to thereby lock the cutter holder 26 and, hence, the cutter unit 3 in position. This is possible because a lower edge portion of the right flat cap 33R is formed with a recess 80, as shown in FIG. 17, into which the free end of only the front arm 77F is engageable when the slide member 77 moved to the locked position while the free end of the rear arm 77B is engaged with the lower edge portion of the right flat cap 33R. Accordingly, so long as the slide member 77 is in the locked position, the cutter unit 3 is locked at a forward tilted position with the rear of the cutter unit 3 shifted upwards.

During the normal use of the electric shaver, the slide member is held at the released position below the locked position as shown in FIG. 26. In this condition, the respective free ends of the arms 77F and 77B are separated a considerable distance away from, and therefore do not interfere with, the flat cap 33R fast with the cutter holder 26, allowing the cutter unit 3 to swing freely about the common axis P.

To make it easy to move the slide member 77, the slide member 77 is also formed integrally with a knob **77*b* which protrudes outwardly through a generally rectangular opening 79 defined in the cap-like plate 22R covering the right upright wall 15R with the cover plate 21R inside. It is to be noted that the single elastically yieldable arm may be employed, rather than using the two as shown, in combination with the detent recesses on only one side edge portion of the cover plate 21R**.

Although the present invention has been described in connection with the preferred embodiment thereof with reference to the accompanying drawings, it is to be noted that various changes and modifications are apparent to those skilled in the art. For example, although reference has been made t the use of the two spirally-bladed cylindrical cutters, the present invention can be equally applied to the electric shaver of a type employing only one spirally-bladed cylindrical cutter or of a type employing at least one cylindrical cutter having a plurality of circumferentially spaced, juxtaposed straight cutter blades.

Also, the transmission system for transmitting the drive of the electric motor to the cylindrical cutter or cutters may not be always limited to the gear train such as shown and described, but may comprise an endless belt.

Accordingly, such changes and modifications are to be understood as included within the scope of the present invention as defined by the appended claims, unless they depart therefrom.

What is claimed is:

1. An electric shaver which comprises:

a generally elongated shaver casing having top and bottom ends opposite to each other and also having a compartment defined therein;

a motor casing including a drive motor accommodated therein and having first and second upright walls spaced a distance from each other, said motor casing being accommodated within the compartment with said first and second upright walls protruding upwardly outwardly from the top end of the shaver casing;

a cutter assembly including a generally U-shaped support structure having first and second arms spaced a distance from each other, said support structure being mounted above the motor casing with said first and second arms pivotally coupled respectively with the first and second upright walls so as to define therebetween a common axis about which the cutter assembly swings relative to the motor casing;

said cutter assembly also including a first cylindrical cutter rotatably mounted on the support structure so as to extend between the first and second arms in parallel relation to the common axis, and a foil-like perforated stationary blade member mounted on the support structure so as to cover the cylindrical cutter in substantially sliding contact therewith, and a drive transmission means disposed within the first arm for transmitting a drive of the drive motor to the cylindrical cutter, said cylindrical cutter having a driven gear mounted fixedly on one end thereof adjacent said first arm in coaxial relation to said cylindrical cutter; and said drive transmission means including a final transmission gear disposed coaxial with the common axis and means for transmitting the drive of the drive motor to said final transmission gear, said driven gear being constantly meshed with said final transmission gear regardless of the swinging motion of the cutter assembly relative to the motor casing.

2. The electric shaver as claimed in claim 1, further comprising an resilient support means for resiliently supporting the motor casing within the compartment to permit the motor casing to move up and down together with the cutter assembly in a direction generally parallel to a longitudinal sense of the shaver casing.

3. The electric shaver as claimed in claim 1, wherein said support structure includes a generally rectangular support bas e having first and second brackets lying generally perpendicular to the support base, said support base being mounted above the motor casing with the first and second brackets pivotally coupled with the first and second upright walls so as to define the common axis, and a cutter holder including a generally rectangular base plate having first and second end walls lying generally perpendicular to the base plate, and wherein said cylindrical cutter is rotatably supported above the base plate and between the first and second end walls with the driven gear positioned on one side of the first bracket opposite to the cylindrical cutter and wherein said stationary blade member is detachably mounted on the cutter holder, said cutter holder being detachably mounted on the support base with the base plate held in contact with the support base and with the first and second end walls adjoining respectively the first and second brackets to define the associated first and second arms of the support structure.

4. The electric shaver as claimed in claim 3, further comprising first and second cover members fitted exteriorly to the first and second end walls, respectively, of the cutter holder, said first cover member concealing a portion of the driven gear, and wherein said final transmission gear is interposed between the first bracket of the support base and the first upright wall of the motor casing such that, when the cutter holder is mounted on the support base, the remaining portion of the driven gear that is exposed outside of the first cover member is drivingly engaged with the final transmission gear.

5. The electric shaver as claimed in claim 3, further comprising a safety switch means for interrupting a supply of an electric power to the drive motor in response to removal of the stationary blade member from the support base.

6. The electric shaver as claimed in claim 5, wherein said safety switch means comprises an electric switch element disposed within the second upright wall of the motor casing, an actuator piece interposed between the second upright wall of the motor casing and the second bracket of the support base and having an actuator pin formed therewith so as to extend axially movably through the second bracket of the support base, said actuator piece being also formed with an actuator projection protruding outwardly therefrom in a direction counter to the actuator pin and operatively coupled with the switch element, and a biasing element interposed between the second upright wall of the motor casing and the actuator piece for urging said actuator piece towards the second bracket of the support base to allow the actuator piece to be rotated together with the swinging motion of the cutter assembly, said actuator pin having a free end engageable with the stationary blade member such that when the stationary blade member is mounted on the support base with the cylindrical cutter positioned inside the stationary blade member, the actuator pin is axially moved against the biasing element to cause the actuator projection to operate the switch element.

7. The electric shaver as claimed in claim 1, further comprising a second cylindrical cutter of a structure identical with the first cylindrical cutter, said second cylindrical cutter being rotatably mounted on the support structure so as to extend between the first and second arms in parallel relation to the common axis and also to the first cylindrical cutter, and an additional driven gear fixedly mounted on one end of the second cylindrical cutter adjacent said first arm in coaxial relation to said second cylindrical cutter and meshed with the final transmission gear.

8. The electric shaver as claimed in claim 7, further comprising an resilient support means for resiliently supporting the motor casing within the compartment to permit the motor casing to move up and down together with the cutter assembly in a direction generally parallel to a longitudinal sense of the shaver casing.

9. The electric shaver as claimed in claim 7, wherein said support structure includes a generally rectangular support base having first and second brackets lying generally perpendicular to the support base, said support base being mounted above the motor casing with the first and second brackets pivotally coupled with the first and second upright walls so as to define the common axis, and a cutter holder including a generally rectangular base plate having first and second end walls lying generally perpendicular to the base plate, and wherein said first and second cylindrical cutters are rotatably supported above the base plate and between the first and second end walls with the respective driven gears positioned on one side of the first bracket opposite to the first and second cylindrical cutters and wherein said stationary blade member is detachably mounted on the cutter holder, said cutter holder being detachably mounted on the support base with the base plate held in contact with the support base and with the first and second end walls adjoining respectively the first and second brackets to define the associated first and second arms of the support structure.

10. The electric shaver as claimed in claim 9, further comprising first and second cover members fitted exteriorly to the first and second end walls, respectively, of the cutter holder, said first cover member concealing respective portions of the driven gears on the first and second cylindrical cutters, and wherein said final transmission gear is interposed between the first bracket of the support base and the first upright wall of the motor casing such that, when the cutter holder is mounted on the support base, the remaining portions of the driven gears that are exposed outside of the first cover member is drivingly engaged with the final transmission gear.

11. The electric shaver as claimed in claim 9, further comprising a safety switch means for interrupting a supply of an electric power to the drive motor in response to removal of the stationary blade member from the support base.

12. The electric shaver as claimed in claim 11, wherein said safety switch means comprises an electric switch element disposed within the second upright wall of the motor casing, an actuator piece interposed between the second upright wall of the motor casing and the second bracket of the support base and having an actuator pin formed therewith so as to extend axially movably through the second bracket of the support base, said actuator piece being also formed with an actuator projection protruding outwardly therefrom in a direction counter to the actuator pin and operatively coupled with the switch element, and a biasing element interposed between the second upright wall of the motor casing and the actuator piece for urging said actuator piece towards the second bracket of the support base to allow the actuator piece to be rotated together with the swinging motion of the cutter assembly, said actuator pin having a free end engageable with the stationary blade member such that when the stationary blade member is mounted on the support base with the cylindrical cutter positioned inside the stationary blade member, the actuator pin is axially moved against the biasing element to cause the actuator projection to operate the switch element.

* * * * *